US007794064B2

(12) United States Patent
Takahashi

(10) Patent No.: US 7,794,064 B2
(45) Date of Patent: Sep. 14, 2010

(54) LIQUID-JET HEAD AND LIQUID-JET APPARATUS

(75) Inventor: Tomoaki Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 12/042,977

(22) Filed: Mar. 5, 2008

(65) Prior Publication Data

US 2008/0218561 A1 Sep. 11, 2008

Related U.S. Application Data

(63) Continuation of application No. 11/173,152, filed on Jul. 5, 2005, now Pat. No. 7,364,273.

(30) Foreign Application Priority Data

Jul. 2, 2004 (JP) ..... 2004-196387
Jul. 2, 2004 (JP) ..... 2004-196388

(51) Int. Cl.
*B41J 2/045* (2006.01)

(52) U.S. Cl. ..... 347/71

(58) Field of Classification Search ..... 347/71
See application file for complete search history.

(56) References Cited

U.S. PATENT DOCUMENTS 7,210,769 B2 * 5/2007 Yasoshima ..... 347/70

FOREIGN PATENT DOCUMENTS

JP 2003-127358 A 5/2003
JP 2004-001366 A 1/2004
JP 2004-154987 A 6/2004

* cited by examiner

*Primary Examiner*—Matthew Luu
*Assistant Examiner*—Lisa M Solomon
(74) *Attorney, Agent, or Firm*—Sughrue Mion, PLLC

(57) ABSTRACT

A liquid-jet head includes a passage-forming substrate. A plurality of pressure generating chambers communicating with nozzles. Piezoelectric elements each include a lower electrode, a piezoelectric layer and an upper electrode. Leads for the upper and lower electrodes are drawn out. In the liquid-jet head, the lower electrode is a common electrode continuously provided in the region facing the pressure generating chambers. At least an end on one side of the lower electrode in a direction perpendicular to an arrangement direction of the pressure generating chambers is positioned in the region facing the pressure generating chambers. The lead electrode for the lower electrode is provided outside of a region corresponding to a space between the pressure generating chambers. The lead electrode for the lower electrode is connected through a common lead portion extended from the lower electrode.

10 Claims, 14 Drawing Sheets

LIQUID-JET HEAD AND LIQUID-JET APPARATUS

CROSS-REFERENCE TO RELATED APPLICATIONS

This is a continuation of application Ser. No. 11/173,152 filed Jul. 5, 2005. Priority is claimed from JP 2004-196387 filed Jul. 2, 2004 and also from JP 2004-196388 filed Jul. 2, 2004. The entire disclosures of the prior application, application Ser. No. 11/173,152, and the above-identified priority documents, are hereby incorporated by reference.

BACKGROUND OF THE INVENTION

1. Field of the Invention

The present invention relates to a liquid-jet head which ejects liquids and a liquid-jet apparatus, and more particularly relates to an ink-jet recording head which ejects ink droplets and an ink-jet recording apparatus.

2. Description of the Related Art

In an ink-jet recording head, a part of pressure generating chambers communicating with nozzle orifices is formed of a vibration plate, this vibration plate is deformed by piezoelectric elements, and ink in the pressure generating chambers is pressurized to eject ink droplets from the nozzle orifices. There are two types of ink-jet recording heads which have been put to practical use, which include: one using a piezoelectric actuator of a longitudinal vibration mode, which extends and contracts in an axial direction of a piezoelectric element; and one using a piezoelectric actuator of a flexure vibration mode.

As the latter ink-jet recording head using the actuator of the flexure vibration mode, for example, there has been known one formed as described below. Specifically, a uniform piezoelectric material layer is formed on the entire surface of a vibration plate by use of a deposition technology. Thereafter, the piezoelectric material layer is cut into a shape corresponding to pressure generating chambers by use of a lithography method. Thus, piezoelectric elements are formed so as to be independent for each of the pressure generating chambers.

Here, in such an ink-jet recording head in which piezoelectric elements are densely arranged, one electrode (a common electrode) of each of the piezoelectric elements is provided so as to be shared by a plurality of the piezoelectric elements. Thus, if a number of the piezoelectric elements are simultaneously driven to eject a number of ink droplets at a time, a voltage drops and a displacement amount of the piezoelectric element becomes unstable. Consequently, there arises a problem of a variation in an ink ejecting property.

Accordingly, there has been proposed an ink-jet recording head which includes: a common lead electrode drawn out to outside of a region facing the pressure generating chambers from a portion of the common electrode except for an end in an arrangement direction of the pressure generating chambers; and a resistance reduction portion including a connection wiring formed of a bonding wire (for example, see Japanese Patent Laid-Open No. 2004-1366 (FIGS. 1 and 2)). The ink-jet recording head described above can prevent the variation in the ink ejecting property due to a voltage drop by allowing the resistance reduction portion to lower a resistance value of the common electrode when a voltage is applied to the piezoelectric elements.

However, in the ink-jet recording head including the common lead electrode and the resistance reduction portion as described above, the common electrode and the common lead electrode are different members. Thus, a manufacturing error occurs when the common lead electrode connected to the common electrode is formed by use of the deposition technology. For example, due to a shift of a mask or etching conditions, there occurs a slight variation in dimensions such as a width of the common lead electrode or a slight shift of a formation position of the common lead electrode. Thus, the common lead electrode is protruded into the region facing the pressure generating chambers from compartment walls on both sides in a direction perpendicular to the arrangement direction of the pressure generating chambers. As a result, there arises a problem that rigidity of the vibration plate is partially enhanced to cause the variation in the ink ejecting property.

Moreover, there has been known an ink-jet recording head including a common lead electrode which is drawn out to outside of a region facing pressure generating chambers from a common electrode (for example, see Japanese Patent Laid-Open No. 2003-127358 (FIG. 3)). In the ink-jet recording head described above, the common electrode and the common lead electrode are formed to have the same pattern. Thus, it is possible to solve the problem that the common lead electrode is protruded into the region facing the pressure generating chambers to cause the variation in the ink ejecting property in the case as described above where the common electrode and the common lead electrode are separately formed.

However, the ink-jet recording head having the structure as described above has a problem that it is impossible to sufficiently prevent a voltage drop which occurs when a plurality of piezoelectric elements are simultaneously driven. To be more specific, a thickness of the common electrode may be increased to prevent the voltage drop. However, since the common electrode generally forms a portion of the vibration plate, an amount of deformation of the vibration plate due to driving of the piezoelectric elements is reduced if the thickness of the common electrode is increased. Thus, it is required to form the common electrode so as to be relatively thin. On the other hand, if the thickness of the common electrode is reduced, a resistance value is increased. Thus, there is an inconsistency that the problem of the variation in the ink ejecting property due to the voltage drop is likely to arise. Therefore, in the above-described ink-jet recording head having the structure in which the common electrode and the common lead electrode are formed to have the same pattern, the thickness of the common lead electrode as well as that of the common electrode are reduced to cause the voltage drop. Thus, there arises the problem of the variation in the ink ejecting property. Note that, needless to say, the problem as described above similarly exists not only in the ink-jet recording head which ejects ink droplets but also in other liquid-jet heads which eject liquids other than the ink droplets.

SUMMARY OF THE INVENTION

In consideration for the circumstances as described above, it is an object of the present invention to provide a liquid-jet head and a liquid-jet apparatus, which can obtain a stable liquid ejecting property.

A first aspect of the present invention for achieving the foregoing object is a liquid-jet head which includes: a passage-forming substrate in which a plurality of pressure generating chambers communicating with nozzle orifices ejecting a liquid are formed; piezoelectric elements which are provided in a region facing the pressure generating chambers on one side the passage-forming substrate with a vibration plate interposed therebetween and each of which includes a lower electrode, a piezoelectric layer and an upper electrode;

a lead electrode for the upper electrode, which is drawn out from the upper electrode; and a lead electrode for the lower electrode, which is drawn out from the lower electrode. In the liquid-jet head, the lower electrode is a common electrode which is continuously provided in the region facing the plurality of arranged pressure generating chambers. In addition, at least an end on one side of the lower electrode in a direction perpendicular to an arrangement direction of the pressure generating chambers is positioned in the region facing the pressure generating chambers. Moreover, the lower electrode has a common lead portion which is drawn out to outside of a region corresponding to a space between the adjacent pressure generating chambers from the one end in the region corresponding to the space between the pressure generating chambers. Moreover, the lead electrode for the lower electrode is electrically connected to the common lead portion of the lower electrode. Furthermore, a connection portion between the lead electrode for the lower electrode and the common lead portion is positioned in a region outside of the region corresponding to the space between the pressure generating chambers.

In the first aspect, the connection portion between the lead electrode for the lower electrode and the common lead portion is provided so as to be positioned in the region outside of the region corresponding to the space between the pressure generating chambers. Thus, it is possible to reliably prevent the lead electrode for the lower electrode from being formed in the region facing the pressure generating chambers due to a manufacturing error. Moreover, the lead electrode for the lower electrode is further drawn out from the common lead portion of the lower electrode, and a resistance value of the lower electrode is lowered. Thus, for example, compared with a conventional structure in which a common lead electrode and a common electrode are formed to have the same pattern, a voltage drop when a plurality of the piezoelectric elements are simultaneously driven can be prevented well. Therefore, a stable liquid ejecting property can be obtained.

A second aspect of the present invention is the liquid-jet head according to the first aspect, characterized in that at least one end of the piezoelectric element on one side thereof in a direction perpendicular to the arrangement direction of the pressure generating chambers is extended to a region facing a peripheral wall of the pressure generating chamber from the region facing the pressure generating chamber. Moreover, a connection portion between the lead electrode for the lower electrode and the common lead portion on the one end side of the piezoelectric element is positioned in a region outside of a region corresponding to a space between the piezoelectric elements.

In the second aspect, the connection portion between the lead electrode for the lower electrode and the common lead portion is positioned outside of the region corresponding to the space between the piezoelectric elements extended to the region facing the peripheral wall of the pressure generating chamber. Thus, the stable liquid ejecting property can be more reliably obtained.

A third aspect of the present invention is the liquid-jet head according to one of the first and second aspects, characterized in that a common electrode pattern connected to the lower electrode is provided along the arrangement direction of the pressure generating chambers in a region outside an end opposite to the lead electrode for the lower electrode in the region facing the plurality of arranged pressure generating chambers.

In the third aspect, the resistance value of the lower electrode can be further reduced, and the voltage drop can be more reliably prevented.

A fourth aspect of the present invention is the liquid-jet head according to the third aspect, characterized in that the common lead portion is further drawn out to reach the common electrode pattern from an end on the other side of the lower electrode.

In the fourth aspect, the resistance value of the lower electrode can be further reduced, and the voltage drop can be more reliably prevented.

A fifth aspect of the present invention is the liquid-jet head according to the third aspect, characterized in that the lower electrode is continuously provided to reach the common electrode pattern from the region facing the plurality of arranged pressure generating chambers.

In the fifth aspect, the resistance value of the lower electrode can be further reduced, and the voltage drop can be more reliably prevented.

A sixth aspect of the present invention is the liquid-jet head according to any of the third to fifth aspects, characterized in that the other end of the piezoelectric element on the side corresponding to the common electrode pattern is positioned in the region facing the pressure generating chambers.

In the sixth aspect, compared with the case where the other end of the piezoelectric element is extended to the region facing the peripheral wall of the pressure generating chamber, a proportion of an area occupied by the common electrode pattern with respect to the entire surface of the one side of the passage-forming substrate can be increased. Thus, the voltage drop can be more reliably prevented.

A seventh aspect of the present invention is the liquid-jet head according to any of the first to sixth aspects, characterized in that the lead electrode for the lower electrode is formed of an adhesion layer made of adhesive metal and a metal layer which is made of a metal material and provided on the adhesion layer. Moreover, the adhesion layer is extended to reach the end on the one side of the lower electrode, and the lead electrode for the lower electrode and the lower electrode are electrically connected to each other through the extended adhesion layer.

In the seventh aspect, a resistance value in a connection portion between the lead electrode for the lower electrode and the lower electrode can be further reduced.

An eighth aspect of the present invention is the liquid-jet head according to any of the first to seventh aspects, characterized in that at least respective layers forming the piezoelectric element are covered with an insulating film made of an inorganic insulating material except for the connection portion between the lead electrode for the lower electrode and the common lead portion. Moreover, the lead electrode for the lower electrode is drawn out onto the insulating film.

In the eighth aspect, since the piezoelectric layer is covered with the insulating film made of the inorganic insulating material having a low moisture permeability, deterioration (destruction) of the piezoelectric layer (piezoelectric element) attributable to moisture (humidity) is reliably prevented over a long period of time.

A ninth aspect of the present invention for achieving the foregoing object is a liquid-jet head which includes: a passage-forming substrate in which a plurality of pressure generating chambers communicating with nozzle orifices ejecting a liquid are formed; piezoelectric elements which are provided in a region facing the pressure generating chambers on one side the passage-forming substrate with a vibration plate interposed therebetween and each of which includes a lower electrode, a piezoelectric layer and an upper electrode; a lead electrode for the upper electrode, which is connected to the upper electrode; and a lead electrode for the lower electrode, which is connected to the lower electrode. In the liquid-jet head, the lower electrode is a common electrode which is continuously provided in the region facing the plurality of arranged pressure generating chambers. In addition, at least an end on one side of the lower electrode in a direction perpendicular to an arrangement direction of the pressure generating chambers is positioned in the region facing the pressure generating chambers. Moreover, the lead electrode for the lower electrode is formed of an adhesion layer made of adhesive metal and a metal layer which is made of a metal material and provided on the adhesion layer. Moreover, the lead electrode for the lower electrode is positioned in a region outside of a region corresponding to a space between the pressure generating chambers. Furthermore, the adhesion layer which forms the lead electrode for the lower electrode is extended to reach the end on the one side of the lower electrode, and the lead electrode for the lower electrode and the lower electrode are electrically connected to each other through the extended adhesion layer.

In the ninth aspect, since the adhesion layer is a relatively thin film, even if the adhesion layer is protruded into the region facing the pressure generating chambers due to a manufacturing error, rigidity of the vibration plate is hardly changed. Moreover, since the lead electrode for the lower electrode is provided in the region outside of the region corresponding to the space between the pressure generating chambers, the metal layer is also never formed in the region facing the pressure generating chambers due to the manufacturing error. Thus, it is possible to reliably prevent a variation in an ink ejecting property, which occurs when a common lead electrode is protruded into the region facing the pressure generating chambers as in the case of a conventional technology. Moreover, a resistance value of the lower electrode is reduced by connecting the lead electrode for the lower electrode to the lower electrode. Thus, for example, compared with a conventional structure in which a common lead electrode and a common electrode are formed to have the same pattern, a voltage drop when a plurality of the piezoelectric elements are simultaneously driven can be reliably prevented. Therefore, a stable liquid ejecting property can be obtained.

A tenth aspect of the present invention is the liquid-jet head according to the ninth aspect, characterized in that a thickness of the adhesion layer is equal to or smaller than that of the lower electrode, and a thickness of the metal layer is larger than that of the lower electrode.

In the tenth aspect, a more stable liquid ejecting property can be obtained.

An eleventh aspect of the present invention is the liquid-jet head according to one of the ninth and tenth aspects, characterized in that a common electrode pattern connected to the lower electrode is provided along the arrangement direction of the pressure generating chambers in a region outside an end opposite to the lead electrode for the lower electrode in the region facing the plurality of arranged pressure generating chambers.

In the eleventh aspect, the resistance value of the lower electrode can be further reduced, and the voltage drop can be more reliably prevented.

A twelfth aspect of the present invention is the liquid-jet head according to the eleventh aspect, characterized in that the adhesion layer is extended to reach the common electrode pattern from the lead electrode for the lower electrode, and the lead electrode for the lower electrode and the common electrode pattern are connected to each other through the extended adhesion layer.

In the twelfth aspect, the resistance value of the lower electrode can be further reduced, and the voltage drop can be more reliably prevented.

A thirteenth aspect of the present invention is the liquid-jet head according to any of the ninth to twelfth aspects, characterized in that the adhesion layer is provided in each of regions facing compartment walls of the plurality of arranged pressure generating chambers, and the respective adhesion layers have the same pattern at least in the regions facing the compartment walls of the pressure generating chambers.

In the thirteenth aspect, vibration characteristics of the vibration plate in each of the piezoelectric elements are uniformized. Thus, a variation in a liquid ejecting property can be reliably prevented.

A fourteenth aspect of the present invention is the liquid-jet head according to the thirteenth aspect, characterized in that one of the plurality of adhesion layers is one extended from the lead electrode for the lower electrode, and the rest are dummy electrodes formed of only the adhesion layers.

In the fourteenth aspect, the vibration characteristics of the vibration plate in each of the piezoelectric elements are uniformized while reliably preventing the voltage drop. Thus, the variation in the liquid ejecting property can be more reliably prevented.

A fifteenth aspect of the present invention is the liquid-jet head according to any of the ninth to fourteenth aspects, characterized in that the lower electrode has a common lead portion which is drawn out to the lead electrode for the lower electrode from the end on the one side of the lower electrode. Moreover, the lead electrode for the lower electrode and the lower electrode are connected to each other through the adhesion layer provided on the common lead portion.

In the fifteenth aspect, the adhesion layer which forms the lead electrode for the lower electrode is provided on the common lead portion. Thus, it is possible to sufficiently secure a thickness of a portion where the lower electrode and the lead electrode for the lower electrode are connected to each other. Moreover, the voltage drop can be more reliably prevented.

A sixteenth aspect of the present invention is the liquid-jet head according to any of the first to fifteenth aspects, characterized in that at least respective layers forming the piezoelectric element are covered with an insulating film made of an inorganic insulating material except for a connection portion between the lower electrode and the adhesion layer.

In the sixteenth aspect, since the piezoelectric layer is covered with the insulating film made of the inorganic insulating material having a low moisture permeability, deterioration (destruction) of the piezoelectric layer (piezoelectric element) attributable to moisture (humidity) is reliably prevented over a long period of time.

A seventeenth aspect of the present invention is a liquid-jet apparatus including the liquid-jet head according to any of the ninth to sixteenth aspects.

In the seventeenth aspect, a stable liquid ejecting property can be obtained, and a liquid-jet apparatus having excellent reliability can be relatively easily and reliably realized.

DETAILED DESCRIPTION OF THE EMBODIMENTS

The present invention will be described in detail below based on embodiments.

Embodiment 1

Figure 1:
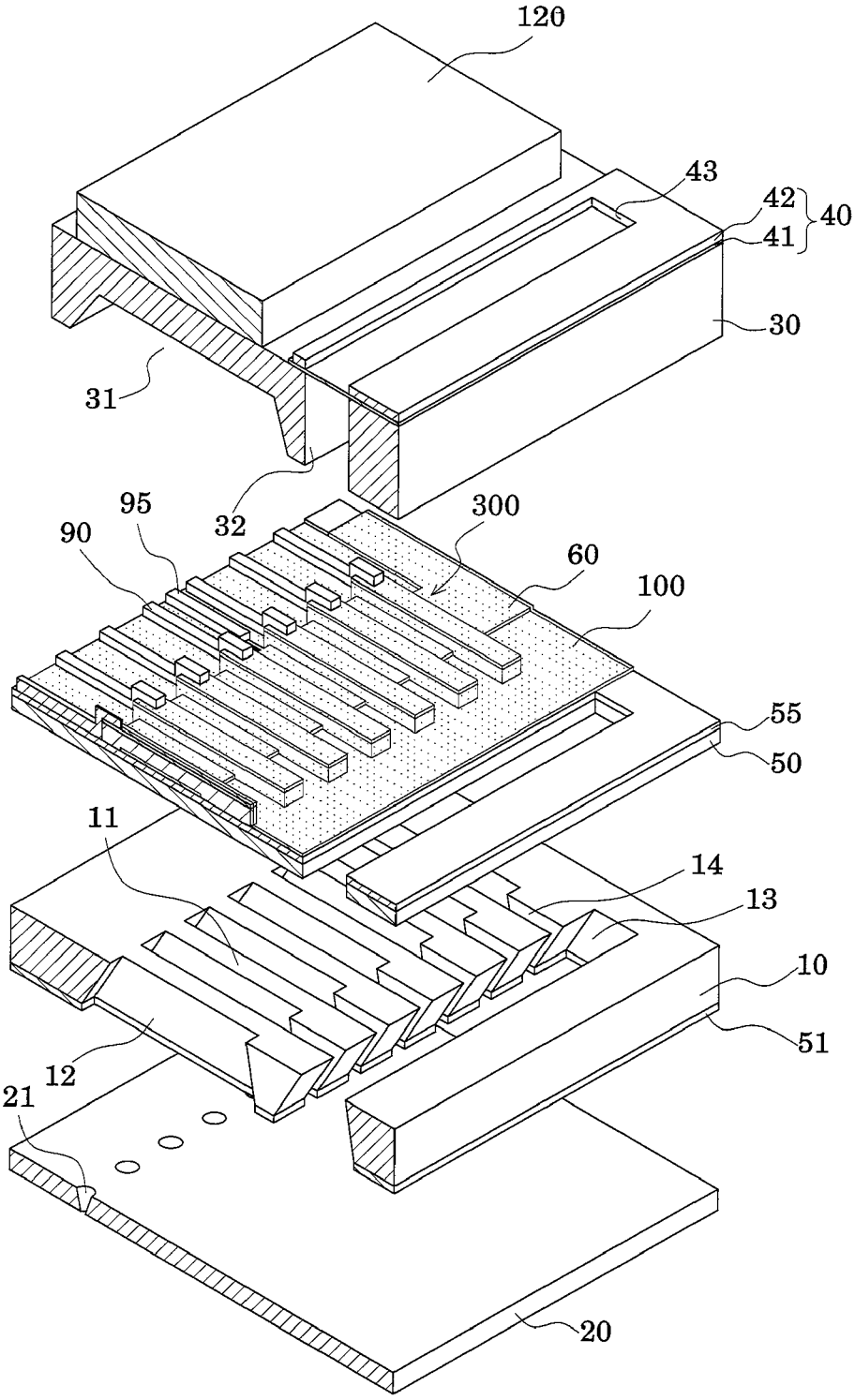
FIG. 1 is an exploded perspective view of a recording head according to embodiment 1.
Figure 2A:
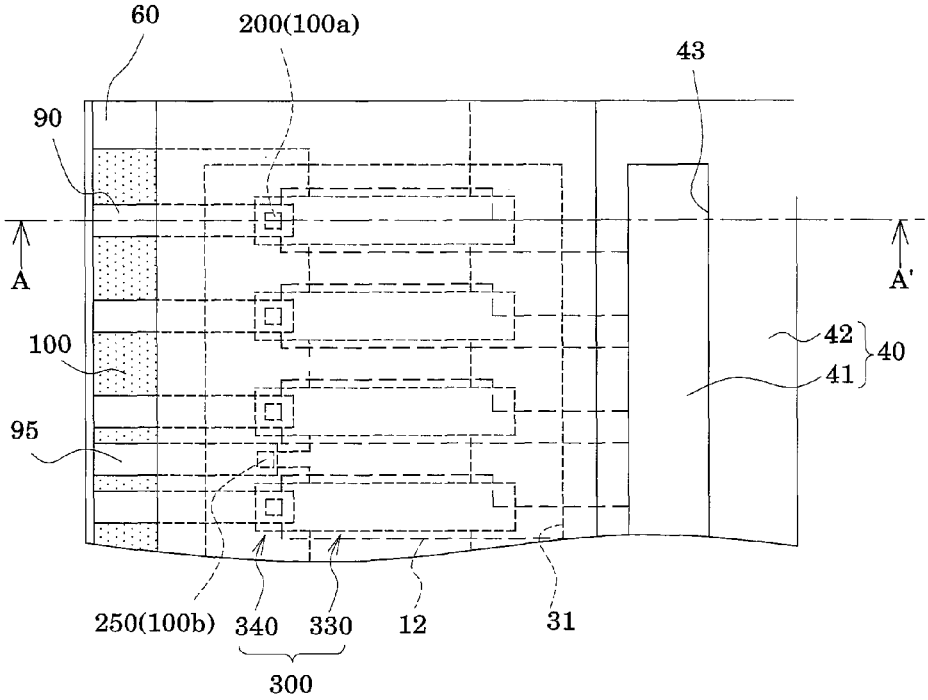
FIGS. 2(*a*) and 2(*b*) are plan and cross-sectional views of the recording head according to embodiment 1.
Figure 2B:
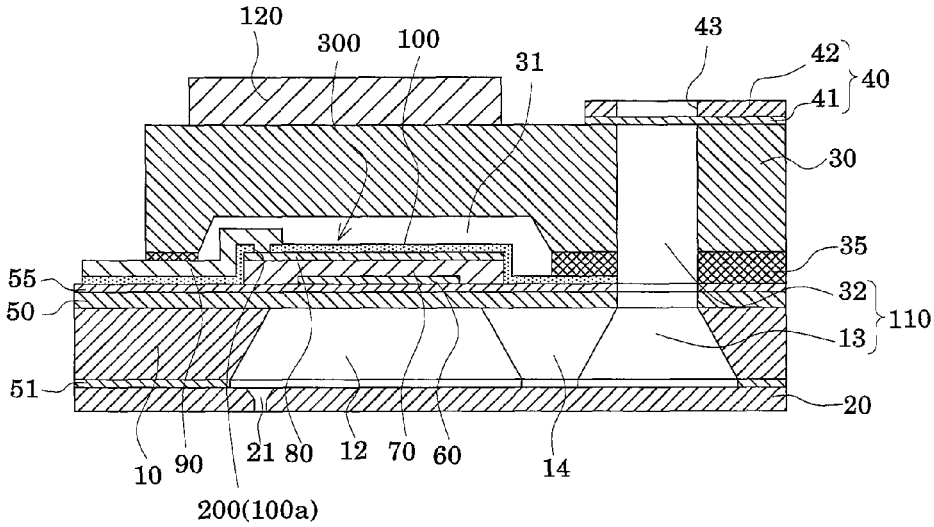
Figure 3A:
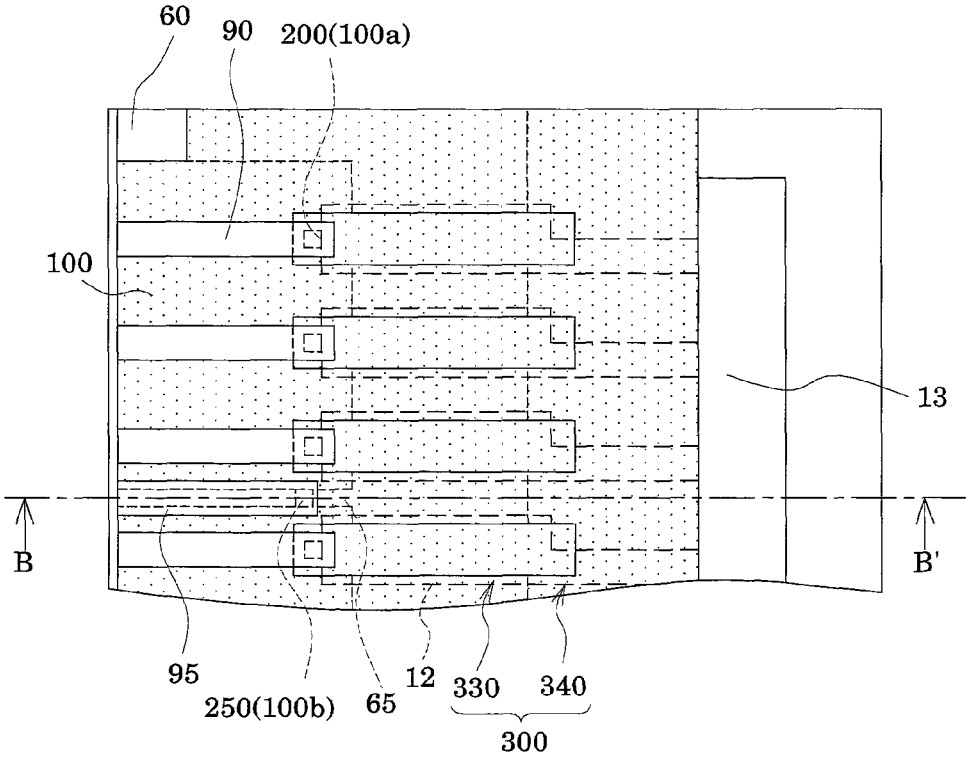
FIGS. 3(*a*) and 3(*b*) are enlarged plan and cross-sectional views of a main part of the recording head according to embodiment 1.
Figure 3B:
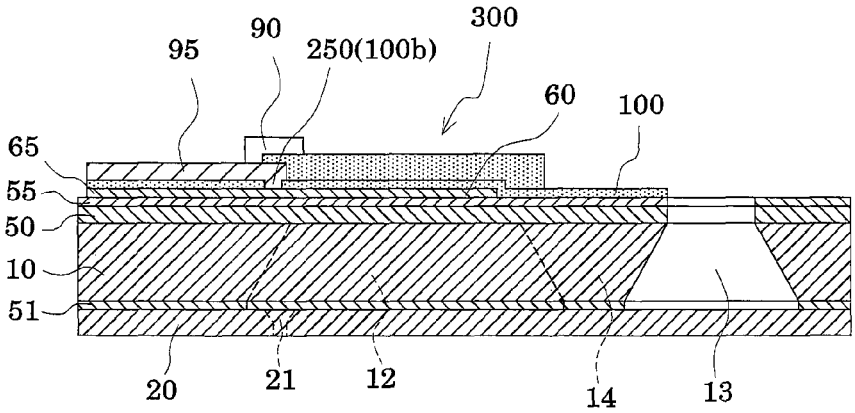

FIG. 1 is an exploded perspective view showing an ink-jet recording head according to embodiment 1 of the present invention. FIG. 2(*a*) is a plan view of the ink-jet recording head according to embodiment 1, and FIG. 2(*b*) is a cross-sectional view along the line A-A' in FIG. 2 (*a*). FIG. 3(*a*) is an enlarged plan view of a main part of the ink-jet recording head according to embodiment 1, and FIG. 3(*b*) is a cross-sectional view along the line B-B' in FIG. 3(*a*). As shown in the drawings, a passage-forming substrate 10 is made of a single crystal silicon substrate of plane orientation (110) in this embodiment, and, on one surface thereof, an elastic film 50 with a thickness of 0.5 to 2 μm, which is made of a silicon dioxide film previously formed by thermal oxidation, is provided. In the passage-forming substrate 10, a plurality of pressure generating chambers 12 are arranged, which are formed by anisotropic etching from the other surface of the substrate and separated by compartment walls 11.

Moreover, on outside in a direction (longitudinal direction) perpendicular to an arrangement direction (width direction) of the respective pressure generating chambers 12, a communicating portion 13 is formed, which forms a part of a reservoir 110 to be a common ink chamber of the respective pressure generating chambers 12. The communicating portion 13 communicates with one ends in the longitudinal direction of the respective pressure generating chambers 12 through ink supply paths 14, respectively. Moreover, each of the ink supply paths 14 communicating with the one ends of the respective pressure generating chambers 12 is formed to have a cross-sectional area smaller than that of the pressure generating chamber 12, and maintains a constant passage resistance of ink flowing into the pressure generating chamber 12.

Furthermore, on an open face side of the passage-forming substrate 10, a nozzle plate 20 having nozzle orifices 21 drilled therein is fixed by use of an adhesive agent, a thermowelding film or the like. Specifically, the nozzle orifices 21 communicate with the vicinity of ends of the respective pressure generating chambers 12 at the opposite side to the ink supply paths 14. Note that the nozzle plate 20 is made of glass ceramics having a thickness of, for example, 0.01 to 1 mm and a linear expansion coefficient of, for example, 2.5 to 4.5 [×10-6/° C.] at 300° C. or less, a single crystal silicon substrate, stainless steel, or the like. Moreover, the nozzle plate 20 may be formed of a material having approximately the same thermal expansion coefficient as that of the passage-forming substrate 10.

Meanwhile, on the side opposite to the open face of the passage-forming substrate 10 as described above, the elastic film 50 having a thickness of, for example, about 1.0 μm is formed as described above. On the elastic film 50, an insulation film 55 having a thickness of, for example, about 0.4 μm is formed. Furthermore, on the insulation film 55, a lower electrode film 60 having a thickness of, for example, about 0.2 μm, a piezoelectric layer 70 having a thickness of, for example, about 1.0 μm and an upper electrode film 80 having a thickness of, for example, about 0.05 μm are laminated to form a piezoelectric element 300.

Here, the piezoelectric element 300 means a part including the lower electrode film 60, the piezoelectric layer 70 and the upper electrode film 80. In general, the piezoelectric element 300 is formed by using any one of the electrodes thereof as a common electrode and patterning the other electrode and the piezoelectric layer 70 for each of the pressure generating chambers 12. Consequently, here, a portion which includes any one of the electrodes, that has been patterned, and the piezoelectric layer 70 and in which piezoelectric strain is caused by voltage application to the both electrodes is called a piezoelectric active portion.

Moreover, here, the piezoelectric element 300 and a vibration plate, in which displacement is caused by driving the piezoelectric element 300, are collectively called a piezoelectric actuator. Note that, in the example described above, the elastic film 50, the insulation film 55 and the lower electrode film 60 serve as the vibration plate.

Note that, as a material of the piezoelectric layer 70, for example, a relaxer ferroelectric substance, which is obtained by adding metal such as niobium, nickel, magnesium, bismuth, yttrium and ytterbium to a ferroelectric (piezoelectric) material such as lead-zirconate-titanate (PZT), and the like may be used. A composition thereof may be accordingly selected in consideration for properties of the piezoelectric element, applications thereof and the like. For example, PbTiO3 (PT), PbZrO3 (PZ), Pb (ZrxTi1-x) O3 (PZT), Pb (Mg1/3Nb2/3) O3-PbTiO3 (PMN-PT), Pb (Zn1/3Nb2/3) O3-PbTiO3 (PZN-PT), Pb (Ni1/3Nb2/3) O3-PbTiO3 (PNN-PT), Pb (In1/2Nb1/2) O3-PbTiO3 (PIN-PT), Pb (Sc1/2Ta1/2) O3-PbTiO3 (PST-PT), Pb (Sc1/2Nb1/2) O3-PbTiO3 (PSN-PT), BiScO3-PbTiO3 (BS-PT), BiYbO3-PbTiO3 (BY-PT) and the like can be cited.

Here, the lower electrode film 60 that is the common electrode of the piezoelectric element 300 as described above is continuously provided over the region facing the plurality of arranged pressure generating chambers 12. To be more specific, the lower electrode film 60 is continuously provided across the region facing the pressure generating chambers 12 and regions facing the compartment walls 11 on both sides in the arrangement direction of the pressure generating chambers 12 along the arrangement direction of the pressure generating chambers. Moreover, in this embodiment, both ends of the lower electrode film 60 in a direction perpendicular to the arrangement direction of the pressure generating chambers 12 are positioned in the region facing the pressure generating chambers 12, respectively.

The lower electrode film 60 as described above has a common lead portion 65 (see FIGS. 3(*a*) and 3(*b*)) which is drawn out to outside of a region corresponding to a space between the adjacent pressure generating chambers 12 from at least an end on one side of the region corresponding to the space between the pressure generating chambers 12 in the arrangement direction thereof, in this embodiment, from an end on a side from which a lead electrode 90 for the upper electrode is drawn out. Moreover, the common lead portion 65 as described above is drawn out to a region corresponding to a space between the lead electrodes 90 for the upper electrode (the vicinity of the end of the passage-forming substrate 10) from the common lead portion 65 of the lower electrode film 60. Note that a width of the common lead portion 65 is formed to be narrower than a width of each of the compartment walls 11 on both sides in a width direction of the pressure generating chambers 12. For example, in this embodiment, the width of the compartment wall 11 is set to about 15 μm, and the width of the common lead portion 65 is set to about 4 μm.

Moreover, in this embodiment, the piezoelectric layer 70 and the upper electrode film 80 are provided in the region facing the pressure generating chambers 12 in the arrangement direction of the pressure generating chambers 12. However, the piezoelectric layer 70 and the upper electrode film 80 are extended to outside of the ends of the lower electrode film 60 in the direction perpendicular to the arrangement direction of the pressure generating chambers 12. In addition, both end surfaces of the lower electrode film 60 are covered with the piezoelectric layer 70. Moreover, in this embodiment, each piezoelectric element 300 is extended to a region facing a peripheral wall on both ends in the direction perpendicular to the arrangement direction of the pressure generating chambers 12. Accordingly, a piezoelectric active portion 330 to be an actual drive portion of the piezoelectric element 300 is formed in an approximately center portion of the pressure generating chamber 12. In the vicinity of both ends of the piezoelectric active portion, a piezoelectric passive portion 340 is formed (see FIG. 2(*a*)) which is continuous with the piezoelectric active portion 330 and has the piezoelectric layer 70 and the upper electrode film 80 but is not actually driven.

Furthermore, in this embodiment, a pattern region that is a region where the piezoelectric elements 300 described above are arranged is covered with an insulating film 100 made of an inorganic insulating material. Here, a material of the insulating film 100 as described above is not particularly limited as long as the material is the inorganic insulating material. For example, aluminum oxide (Al2O3), tantalum pentoxide (Ta2O5), silicon dioxide (SiO2) and the like can be cited. It is preferable to use aluminum oxide (Al2O3). Particularly, in the case where aluminum oxide is used, even if the insulating film 100 is formed to be as thin as about 100 nm, moisture permeation in a high humidity environment can be sufficiently prevented. Note that, when an organic insulating material such as resin is used, for example, as a material of the insulating film, the moisture permeation cannot be sufficiently prevented if the film made of the organic insulating material has about the same thickness as that of the insulating film made of the inorganic insulating material described above. Moreover, if the thickness of the insulating film is increased in order to prevent the moisture permeation, there is a risk of inviting a situation in which movement of the piezoelectric elements is hindered. As described above, in this embodiment, by covering at least the respective layers forming the piezoelectric element 300 with the insulating film 100 made of the inorganic insulating material, deterioration (destruction) of the piezoelectric layer 70 (the piezoelectric element 300) attributable to moisture (humidity) can be reliably prevented over a long period of time.

In this embodiment, on the insulating film 100 as described above, as shown in FIGS. 3(*a*) and 3(*b*), the lead electrode 90 for the upper electrode is drawn out from the upper electrode film 80 that is an individual electrode of the piezoelectric element 300, and a lead electrode 95 for the lower electrode is drawn out from the lower electrode film 60. To be more specific, in the insulating film 100 described above, a first contact hole 100*a* to be a connection portion 200 in which the upper electrode film 80 and the lead electrode 90 for the upper electrode are electrically connected to each other is provided in a region facing one end of the piezoelectric element 300, that is, a region facing a peripheral wall opposite to the side where the ink supply path 14 of the pressure generating chamber 12 communicates. Moreover, in the insulating film 100, in this embodiment, a second contact hole 100*b* to be a connection portion 250 in which the common lead portion 65 and the lead electrode 95 for the lower electrode are electrically connected to each other is provided in a region outside the region corresponding to the space between the pressure generating chambers 12.

Accordingly, the lead electrode 90 for the upper electrode is drawn out from one end of each piezoelectric element 300 through the connection portion 200 (the first contact hole 100*a*) in the insulating film 100 to the vicinity of the end of the passage-forming substrate 10. Note that, as a material to form the lead electrode 90 for the upper electrode described above, for example, gold, aluminum alloys and the like can be cited. In this embodiment, gold is used.

Meanwhile, as shown in FIGS. 3(*a*) and 3(*b*), the lead electrode 95 for the lower electrode is formed of the same layer as that forming the lead electrode 90 for the upper electrode, in other words, is made of gold in this embodiment. Moreover, in this embodiment, the lead electrode 95 for the lower electrode as described above is electrically connected to the common lead portion 65 through the second contact hole 100*b*, which is provided in the insulating film 100, in a portion of the common lead portion 65 which is drawn out to the region outside the region corresponding to the space between the pressure generating chambers 12. Specifically, the connection portion 250 between the common lead portion 65 and the lead electrode 95 for the lower electrode is provided in the region outside the end of the pressure generating chamber 12. Note that, in this embodiment, the lead electrode 95 for the lower electrode is drawn out to the region corresponding to the space between the lead electrodes 90 for the upper electrode on the insulating film 100 (the vicinity of the end of the passage-forming substrate 10) along the common lead portion 65.

Here, at least one or more of the lead electrodes 95 for the lower electrode as described above may be provided. It is preferable that one lead electrode 95 for the lower electrode is provided at a regular interval, for example, for n lead electrodes 90 for the upper electrode (n denotes an integer not less than 1). Note that, although not shown in the drawings, the lead electrode 95 for the lower electrode is patterned into a predetermined shape in the following manner together with the lead electrode 90 for the upper electrode. Specifically, the respective layers forming the piezoelectric element 300 are formed by use of deposition and a lithography method. Thereafter, a metal layer made of gold is formed over the entire surface on one side of the passage-forming substrate 10.

Subsequently, the metal layer is etched by use of a mask pattern made of resist and the like. Thus, the lead electrodes are patterned.

As described above, in this embodiment, the connection portion 250 between the lead electrode 95 for the lower electrode and the common lead portion 65 is provided in the region outside the region corresponding to the space between the pressure generating chambers 12. Thus, it is possible to reliably prevent the lead electrode 95 for the lower electrode from being formed in the region facing the pressure generating chambers 12 regardless of a manufacturing error of the lead electrode 95 for the lower electrode, for example, even if a slight variation occurs in dimensions of the lead electrode 95 for the lower electrode or even if a formation position of the lead electrode 95 for the lower electrode is slightly shifted. Moreover, the lead electrode 95 for the lower electrode is further drawn out from the common lead portion 65 of the lower electrode film 60, and a resistance value of the lower electrode film 60 is reduced. Thus, for example, compared with a conventional structure in which a common lead electrode and a common electrode are formed to have the same pattern, a voltage drop when the plurality of piezoelectric elements 300 are simultaneously driven can be reliably prevented. Therefore, a stable ink ejecting property can be obtained.

Particularly, as in the case of this embodiment, since the lower electrode film 60 included in the piezoelectric element 300 formed of thin films is thin, the resistance value thereof is likely to get relatively high. However, the common lead portion 65 is integrally drawn out from the lower electrode film 60 as described above, and the lead electrode 95 for the lower electrode is further drawn out from the common lead portion 65. Thus, it is possible to effectively prevent a variation in the ink ejecting property due to the voltage drop.

Moreover, in order to reliably prevent the voltage drop, it is preferable to form the lead electrode 95 for the lower electrode to be wider than the common lead portion 65. In addition, it is also preferable to form the lead electrode 95 for the lower electrode to be thicker than the lower electrode film 60. For example, in this embodiment, the lead electrode 95 for the lower electrode is formed to be wider than the common lead portion 65 and to be thicker than the lower electrode film 60.

Note that, on the passage-forming substrate 10 having the piezoelectric element 300 formed thereon, a protective plate 30 is bonded by use of an adhesive agent 35. Specifically, the protective plate 30 has a piezoelectric element holding portion 31 capable of securing a space without interfering with movement of the piezoelectric element 300 in a region facing the piezoelectric element 300. Since the piezoelectric element 300 is formed inside the piezoelectric element holding portion 31, the piezoelectric element is protected in a state of being hardly influenced by the external environment. The piezoelectric element holding portion 31 described above may or may not have the space sealed.

Moreover, in the protective plate 30 as described above, a reservoir portion 32 which constitutes at least a part of the reservoir 110 is provided. In this embodiment, this reservoir portion 32 is formed along the width direction of the pressure generating chambers 12 while penetrating the protective plate 30 in its thickness direction. Moreover, the reservoir portion 32 constitutes the reservoir 110 to be the common ink chamber of the respective pressure generating chambers 12 by communicating with the communicating portion 13 in the passage-forming substrate 10 through a though-hole provided in the elastic film 50. Note that, as the protective plate 30 described above, for example, glass, a ceramic material, metal, resin and the like can be cited. However, it is preferable that the protective plate 30 is formed of a material having approximately the same thermal expansion coefficient as that of the passage-forming substrate 10. In this embodiment, a single crystal silicon substrate which is the same material as that forming the passage-forming substrate 10 is used to form the protective plate.

Moreover, on the protective plate 30, a compliance plate 40 including a sealing film 41 and a fixed plate 42 is bonded in a region corresponding to the reservoir portion 32. Here, the sealing film 41 is made of a material having low rigidity and flexibility (for example, a polyphenylene sulfide (PPS) film with a thickness of 6 μm), and this sealing film 41 seals one surface of the reservoir portion 32. Moreover, the fixed plate 42 is formed by use of a hard material such as metal (for example, stainless-steel (SUS) with a thickness of 30 μm or the like). A region of this fixed plate 42 facing the reservoir 110 is set to be an opening portion 43 which is obtained by entirely removing the fixed plate 42 in the region in its thickness direction. Thus, one side of the reservoir 110 is sealed only by the sealing film 41 having flexibility.

Note that, on the protective plate 30 as described above, in this embodiment, a drive IC 120 is mounted. Although not shown in the drawings, the drive IC 120, the lead electrode 90 for the upper electrode, and the lead electrode 95 for the lower electrode are wire-bonded by use of connection wirings made of bonding wires in the region at the end of the passage-forming substrate 10. The ink-jet recording head of this embodiment described above takes in ink from unillustrated ink supply means and fills the inside thereof from the reservoir 110 to the nozzle orifices 21 with the ink. Thereafter, in accordance with a drive signal from the drive IC 120, a drive voltage is applied to the respective lower and upper electrode films 60 and 80 which correspond to the respective pressure generating chambers 12. Subsequently, the piezoelectric element 300 and the vibration plate are displaced. Thus, pressures in the respective pressure generating chambers 12 are increased to eject ink droplets from the nozzle orifices 21.

Embodiment 2

Figure 4:
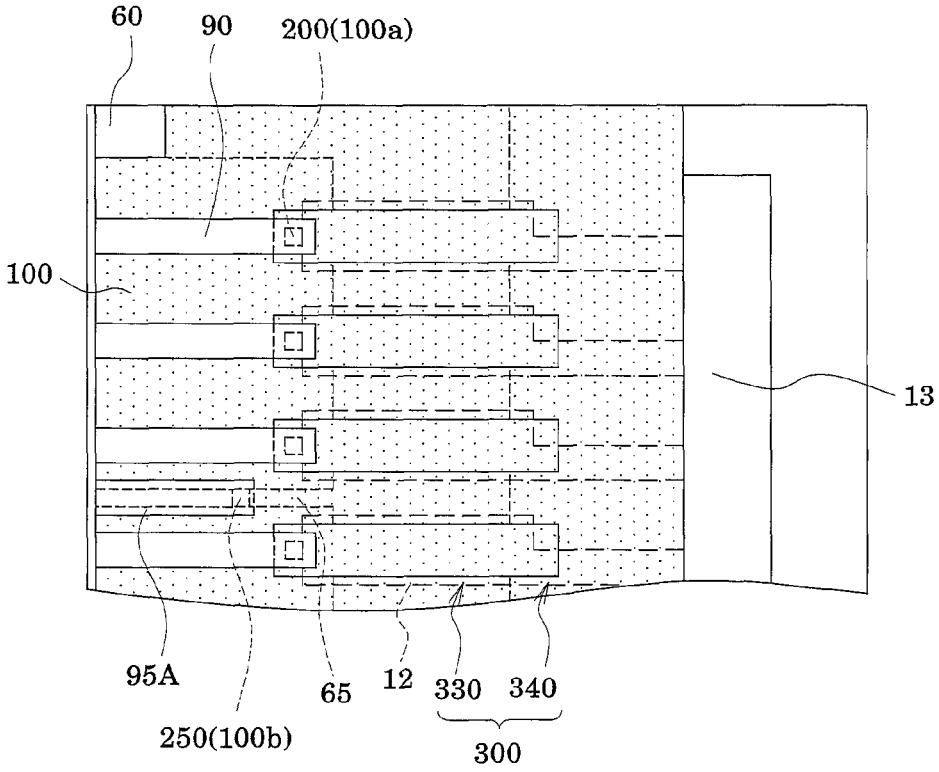
FIG. 4 is an enlarged plan view of a main part of a recording head according to embodiment 2.

FIG. 4 is an enlarged plan view of a main part of an ink-jet recording head according to embodiment 2 of the present invention. In embodiment 1 described above, the description was given by exemplifying the structure in which the connection portion 250 between the common lead portion 65 and the lead electrode 95 for the lower electrode is provided outside the region corresponding to the space between the pressure generating chambers 12. However, in this embodiment, as shown in FIG. 4, a connection portion 250A between a common lead portion 65 and a lead electrode 95A for a lower electrode is provided in a region outside a region corresponding to a space between piezoelectric elements 300.

To be more specific, as in the case of embodiment 1 described above, both ends of the piezoelectric element 300 in an arrangement direction of pressure generating chambers 12 are extended to a region facing a peripheral wall of the pressure generating chambers 12 from a region facing the pressure generating chambers 12. Moreover, in this embodiment, from a portion of a lower electrode film 60 corresponding to the space between the piezoelectric elements 300, the common lead portion 65 of the lower electrode film 60 is drawn out to the region outside the region corresponding to the space between the piezoelectric elements 300. Accordingly, the common lead portion 65 is electrically connected to the lead electrode 95A for the lower electrode through the connection portion 250A in a portion outside the region corresponding to the space between the piezoelectric elements 300. With the configuration as described above, the same effects as those of embodiment 1 described above can be obtained.

Moreover, as in the case of this embodiment, by providing the connection portion 250A between the common lead portion 65 and the lead electrode 95A for the lower electrode in the region outside the region corresponding to the space between the piezoelectric elements 300, there will be no restrictions on an interval between the piezoelectric element 300 and the connection portion 250A, and the like at the time of manufacturing. Thus, the piezoelectric elements 300 can be densely arranged by narrowing a distance between the piezoelectric elements 300 while maintaining a stable ink ejecting property.

Embodiment 3

Figure 5A:
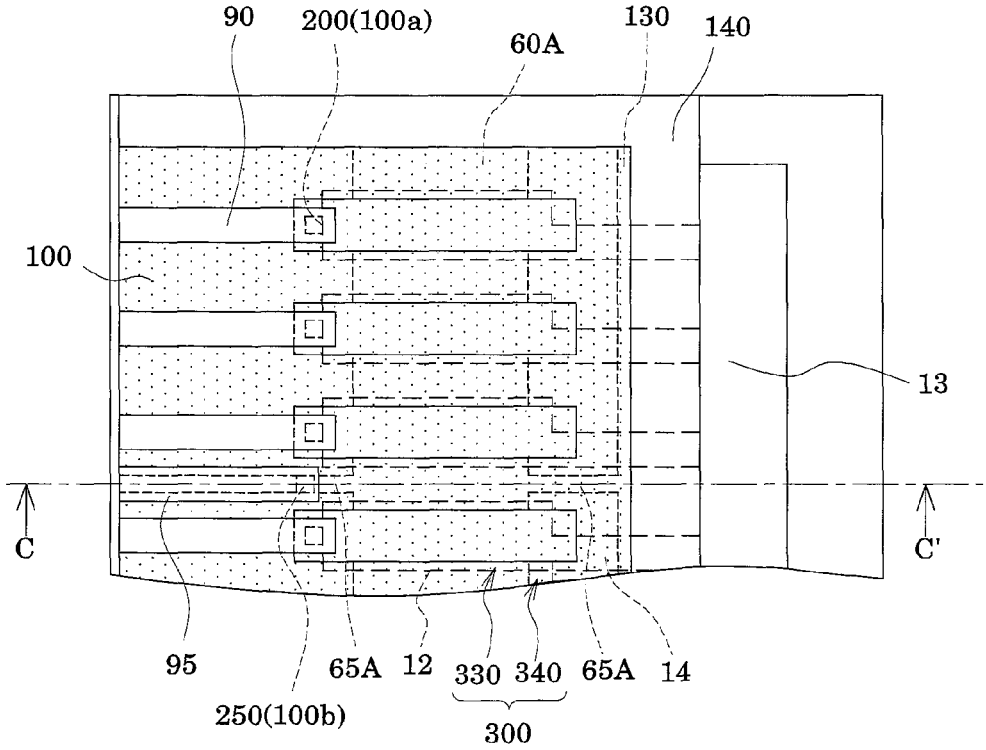
FIGS. 5(*a*) and 5(*b*) are enlarged plan and cross-sectional views of a main part of a recording head according to embodiment 3.
Figure 5B:
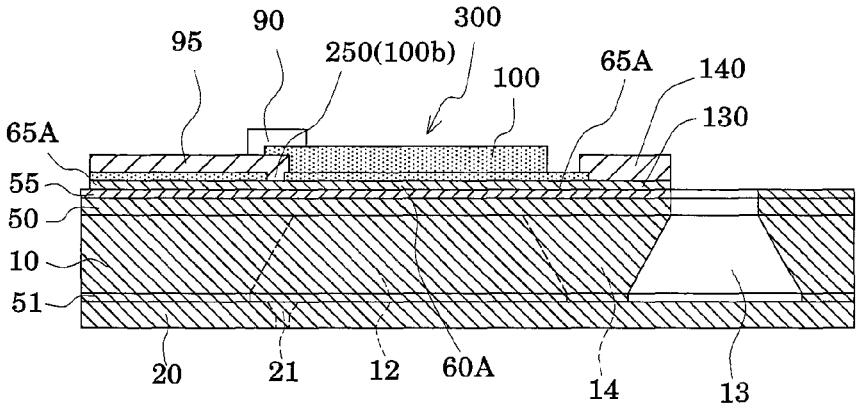
Figure 6:
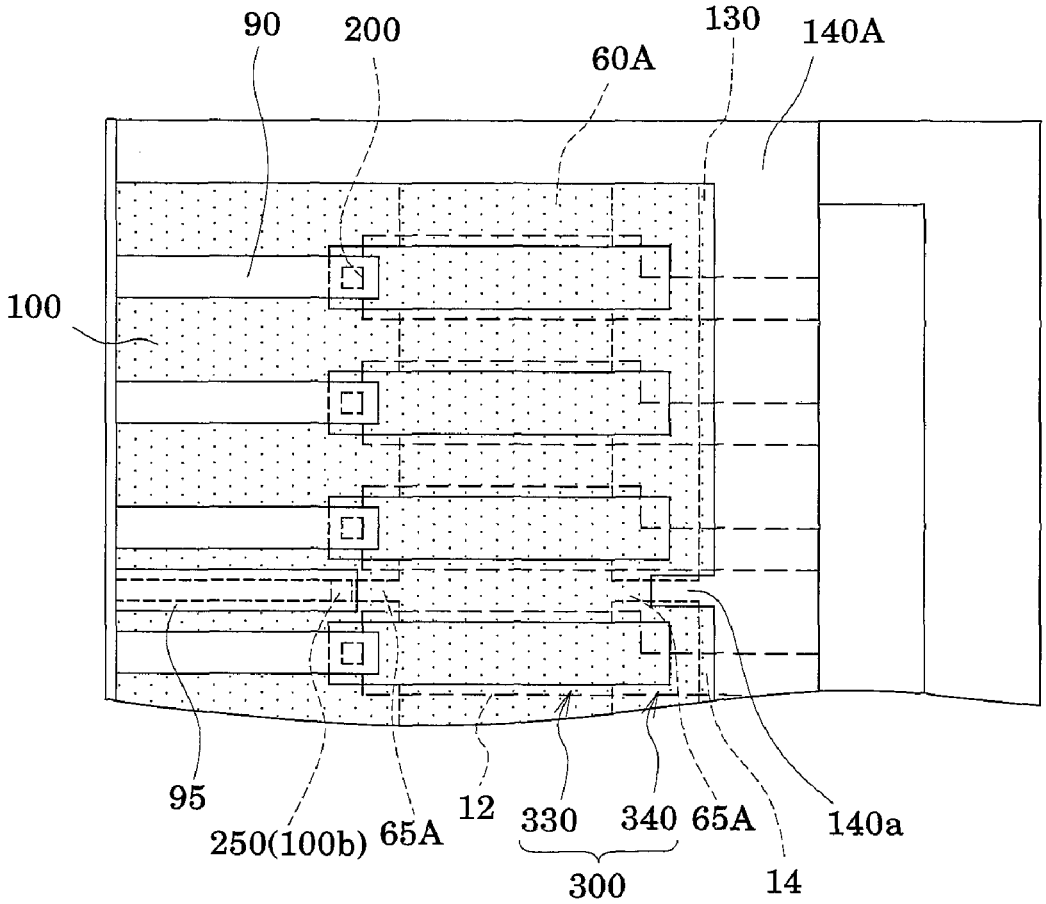
FIG. 6 is an enlarged plan view of a main part of another recording head according to embodiment 3.

FIG. 5(*a*) is an enlarged plan view of a main part of an ink-jet recording head according to embodiment 3 of the present invention, and FIG. 5(*b*) is a cross-sectional view along the line C-C' in FIG. 5(*a*). Moreover, FIG. 6 is an enlarged plan view of a main part of another ink-jet recording head according to embodiment 3 of the present invention. In embodiment 1 described above, the description was given by exemplifying the structure in which the common lead portion 65 is drawn out to the same direction as the lead electrode 90 for the upper electrode. However, in this embodiment, as shown in FIGS. 5(*a*) and 5(*b*), a common lead portion 65A is also drawn out from an end of a lower electrode film 60A at a side opposite to a side from which a lead electrode 90 for an upper electrode is drawn out.

Moreover, the common lead portion 65A of the lower electrode film 60A is drawn out to a region outside a region corresponding to a space between pressure generating chambers 12. Furthermore, in a region outside an end, which is opposite to the lead electrode 90 for the upper electrode, of a region facing a plurality of the arranged pressure generating chambers 12, a common electrode layer 130 is provided along an arrangement direction of the pressure generating chambers 12. Specifically, the common electrode layer 130 is formed of the same layer as that forming the lower electrode film 60A and is connected through the lower electrode film 60A and the common lead portion 65A.

On the common electrode layer 130, a common electrode pattern 140 is provided, which is formed of the same layer as that forming a lead electrode 95 for a lower electrode. Note that, in this embodiment, respective layers forming a piezoelectric element 300 are covered with an insulating film 100 except for a portion where the common electrode layer 130 and the common electrode pattern 140 are laminated. With the configuration as described above, a voltage drop can be more reliably prevented, and a more stable ink ejecting property can be obtained.

Note that this embodiment is not limited to the structure described above. For example, as shown in FIG. 6, an extension portion 140*a* which is extended to a region outside a region corresponding to a space between the piezoelectric elements 300 may be provided in a portion corresponding to a common lead portion 65A of a second common electrode pattern 140A. Thus, the voltage drop can be more reliably prevented.

Moreover, in this embodiment, adopted is a structure in which both ends of the piezoelectric element 300 in a direction perpendicular to the arrangement direction of the pressure generating chambers 12 are extended to a region facing a peripheral wall of the pressure generating chambers 12. However, needless to say, the structure is not limited to that described above. Although not shown in the drawings, the other end of the piezoelectric element on the side corresponding to the common electrode pattern may be provided in the region facing the pressure generating chambers. Thus, compared with the case where the other end of the piezoelectric element is extended to the region facing the peripheral wall of the pressure generating chambers, a proportion of an area occupied by the common electrode pattern with respect to the entire surface on one side of the passage-forming substrate can be increased. Consequently, the voltage drop can be more reliably prevented.

Embodiment 4

Figure 7:
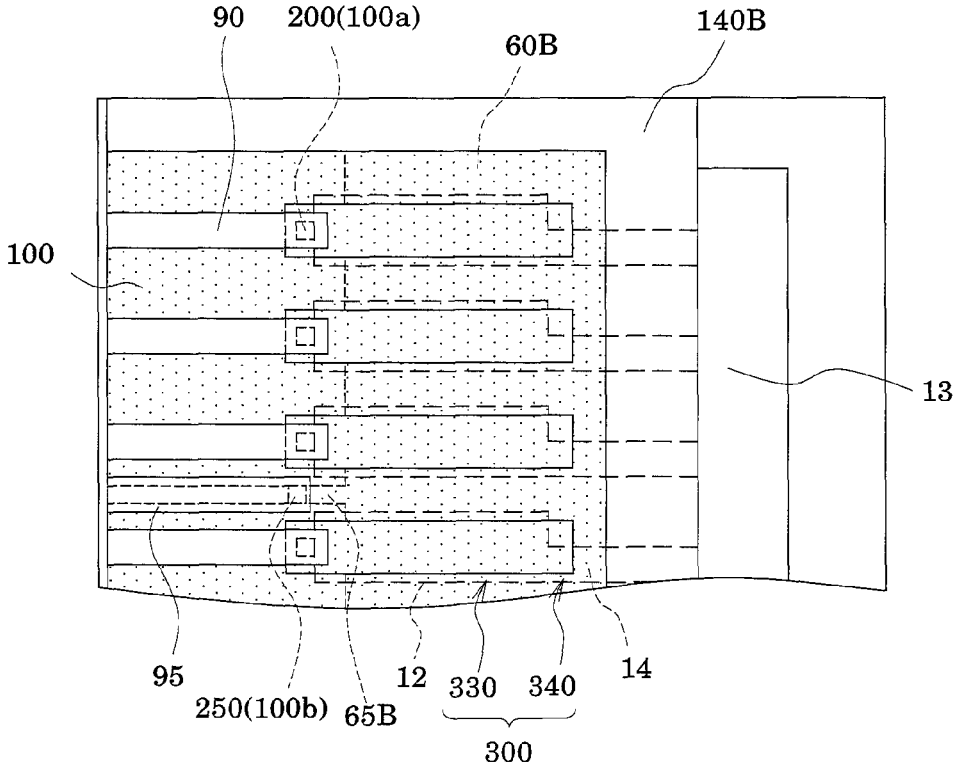
FIG. 7 is an enlarged plan view of a main part of another recording head according to embodiment 4.

FIG. 7 is an enlarged plan view of a main part of an ink-jet recording head according to embodiment 4 of the present invention. In embodiment 3 described above, the description was given by exemplifying the structure in which the common electrode layer 130 and the common electrode pattern 140 are electrically connected to the lower electrode film 60A through the common lead portion 65A. However, in this embodiment, as shown in FIG. 7, a lower electrode film 60B is continuously extended to reach a common electrode pattern 140B from a region facing a plurality of arranged pressure generating chambers 12. Specifically, the lower electrode film 60B is extended to a region facing arranged ink supply paths 14 on one surface (an insulation film 55) of a passage-forming substrate 10 from the region facing the plurality of arranged pressure generating chambers 12. Moreover, on a surface of the lower electrode film 60 in a portion facing the arranged ink supply paths 14, the common electrode pattern 140B is provided along an arrangement direction of the pressure generating chambers 12. With the configuration as described above, rigidity of a vibration plate in a region facing an end of the pressure generating chamber 12 can be sufficiently secured while more reliably preventing a voltage drop.

Embodiment 5

Figure 8:
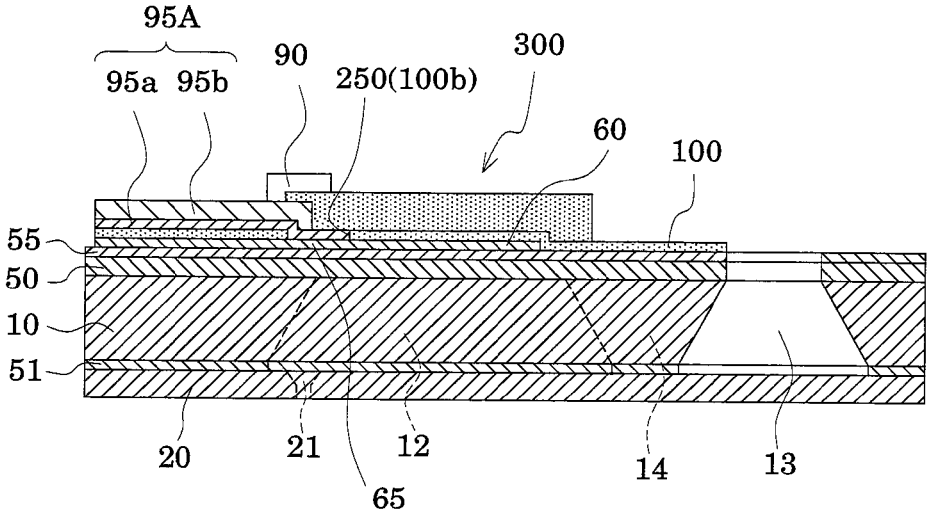
FIG. 8 is an enlarged plan view of a main part of another recording head according to embodiment 5.

FIG. 8 is an enlarged plan view of a main part of an ink-jet recording head according to embodiment 5 of the present invention. In embodiment 1 described above, the description was given by exemplifying the lead electrode 95 for the lower electrode which has a single layer structure. However, in this embodiment, as shown in FIG. 8, a lead electrode 95A for a lower electrode is formed of an adhesion layer 95*a* made of adhesive metal and a metal layer 95*b* which is made of a metal material and provided on the adhesion layer 95*a*. Moreover, the adhesion layer 95*a* is extended to reach an end of a lower electrode film 60, and the lead electrode 95A for the lower electrode and the lower electrode film 60 are electrically connected to each other through the extended adhesion layer 95*a*.

To be more specific, the lead electrode 95A for the lower electrode is formed in a portion where the adhesion layer 95*a* and the metal layer 95*b* are laminated. Moreover, an end of the metal layer 95*b*, which is included in the lead electrode 95A for the lower electrode, on a piezoelectric element 300 side is positioned in a region outside a region corresponding to a space between pressure generating chambers 12. Accordingly, the lead electrode 95A for the lower electrode is electrically connected to the lower electrode film 60 through the adhesion layer 95*a*. Moreover, the adhesion layer 95*a* is separately extended to reach a base of a common lead portion 65 from a base region facing the metal layer 95*b*. Thus, the adhesion layer 95*a* plays a role of attaching the metal layer 95*b* to an insulating film 100 on the insulating film 100.

Moreover, the adhesion layer 95*a* plays a role of attaching and electrically connecting the metal layer 95*b* and the common lead portion 65 of the lower electrode film 60 to each other in a connection region between the lead electrode 95A for the lower electrode and the lower electrode film 60 (in a connection portion 250 corresponding to a second contact hole 100*b*).

Note that, as the adhesive metal that is a material forming the adhesion layer 95*a*, for example, a titanium-tungsten alloy, a nickel-chromium alloy and the like can be cited. As a material forming the metal layer 95*b* to be formed thereon, for example, an aluminum alloy, gold and the like can be cited. Moreover, a thickness of the adhesion layer 95*a* is, for example, about 0.1 to 0.3 μm. The thickness of the adhesion layer 95*a* is preferably equal to or smaller than a thickness of the lower electrode film 60, and is more preferably set smaller than the thickness of the lower electrode film 60. This is in order to effectively prevent rigidity of a vibration plate from being increased by formation of the adhesion layer 95*a* in the region facing the pressure generating chambers 12. For example, in this embodiment, the thickness of the lower electrode film 60 is set to about 0.2 μm, and the thickness of the adhesion layer 95*a* is set to about 0.1 μm. Meanwhile, a thickness of the metal layer 95*b* is, for example, about 1.0 to 3.0 μm, and is preferably larger than that of the lower electrode film 60. This is in order to reduce a resistance value of the lower electrode film 60. For example, in this embodiment, the thickness of the metal layer 95*b* is set to about 1.2 μm.

As described above, in this embodiment, only the adhesion layer 95*a* of the lead electrode 95A for the lower electrode is extended to the base of the common lead portion 65. Thus, for example, compared with the structure of embodiment 1 described above, the resistance value in the connection portion 250 between the lead electrode 95A for the lower electrode and the lower electrode film 60 can be further reduced.

Note that, in the embodiment described above, exemplified is the structure in which only the adhesion layer 95*a* of the lead electrode 95A for the lower electrode is extended to the base of the common lead portion 65. However, needless to say, the structure is not limited to that described above. For example, the adhesion layer of the lead electrode for the lower electrode may be extended from the common lead portion to a region corresponding to a space between the piezoelectric active portions of the piezoelectric element. In the structure as described above, even if the adhesion layer is protruded into the region facing the pressure generating chambers due to a manufacturing error, the rigidity of the vibration plate is hardly changed since the adhesion layer is relatively thin. Moreover, the metal layer is provided in the region outside the region corresponding to the space between the pressure generating chambers. Thus, the metal layer is never formed in the region facing the pressure generating chambers regardless of a manufacturing error of the metal layer, for example, even if a slight variation occurs in dimensions of the metal layer or even if a formation position of the metal layer is slightly shifted. Therefore, even if a manufacturing error of the lead electrode for the lower electrode occurs, a variation in the ink ejecting property can be reliably prevented.

Embodiment 6

Figure 9:
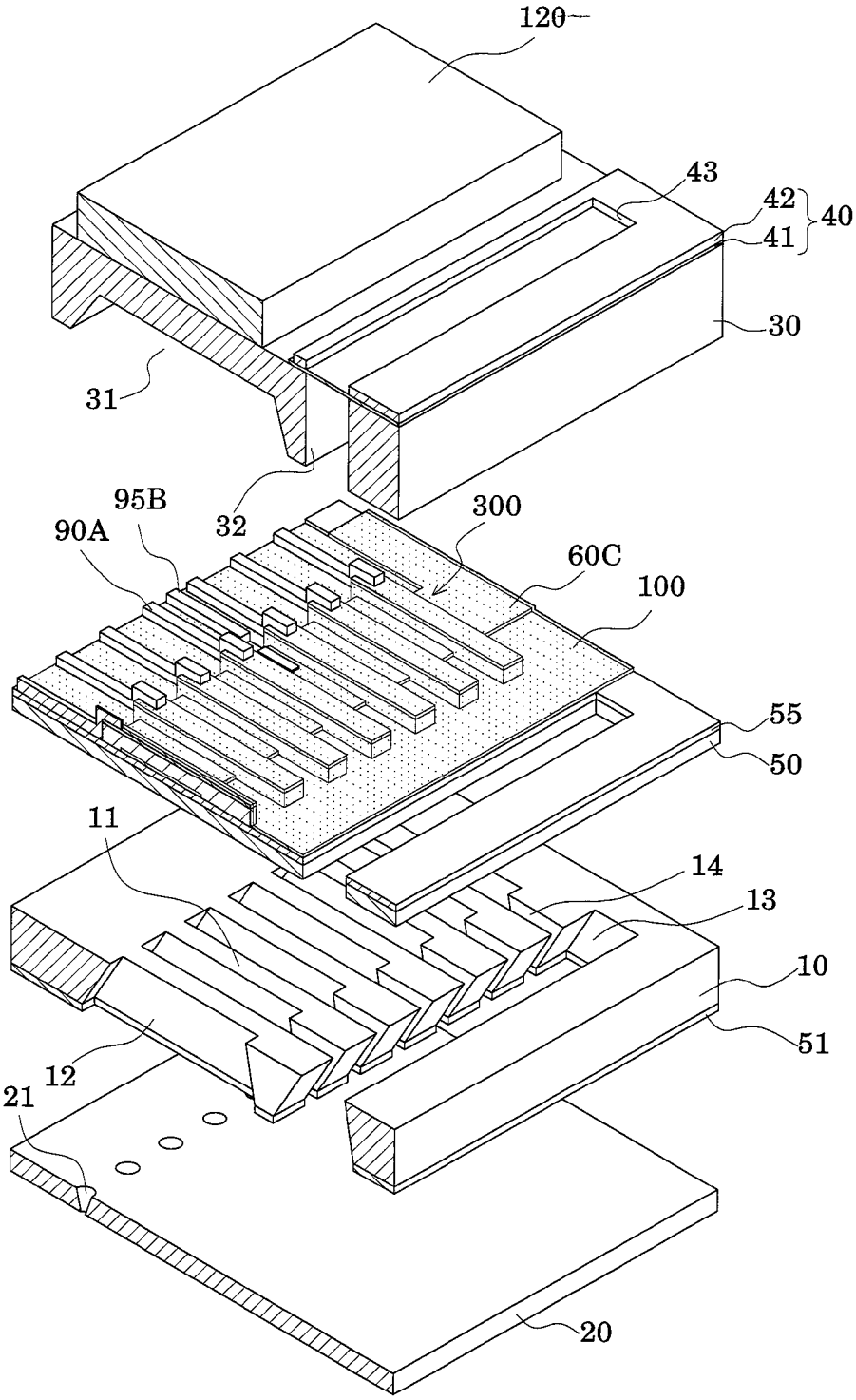
FIG. 9 is an exploded perspective view of a recording head according to embodiment 6.
Figure 10A:
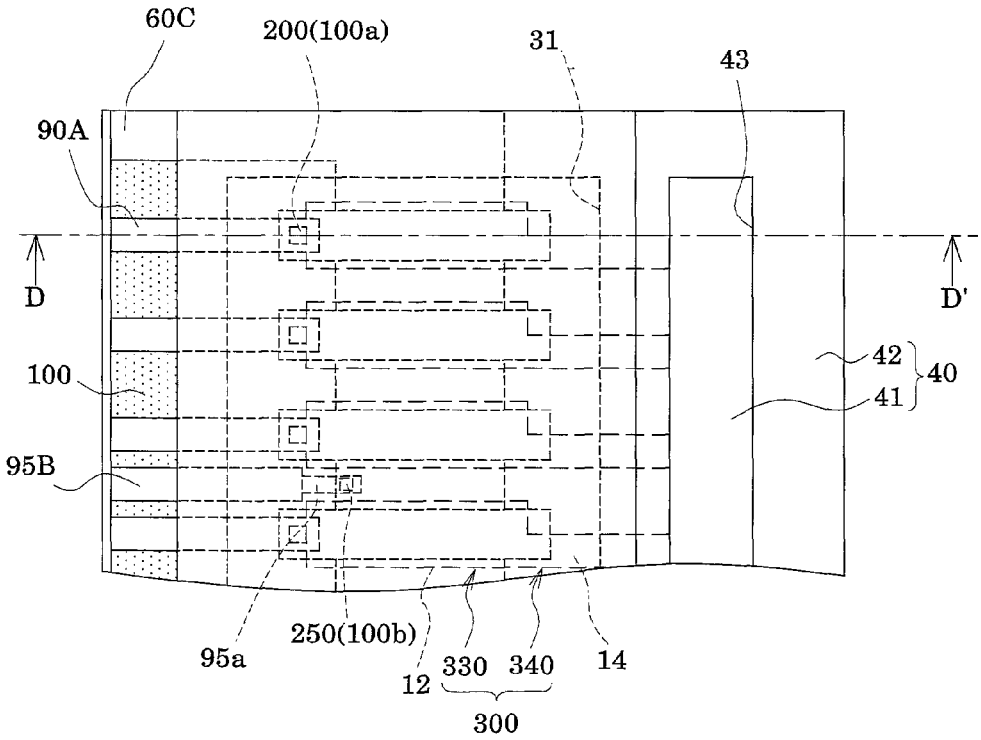
FIGS. 10(*a*) and 10(*b*) are plan and cross-sectional views of the recording head according to embodiment 6.
Figure 10B:
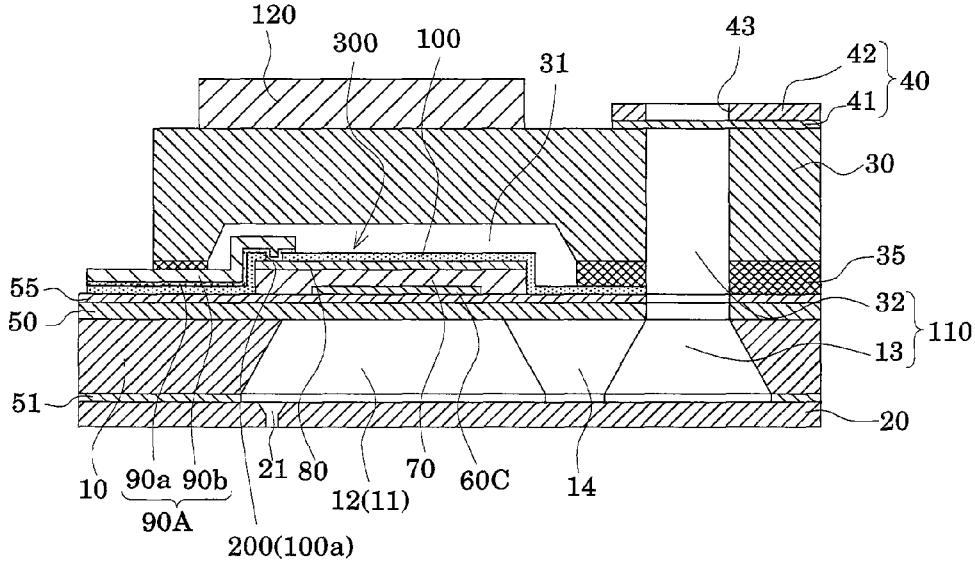
Figure 11A:
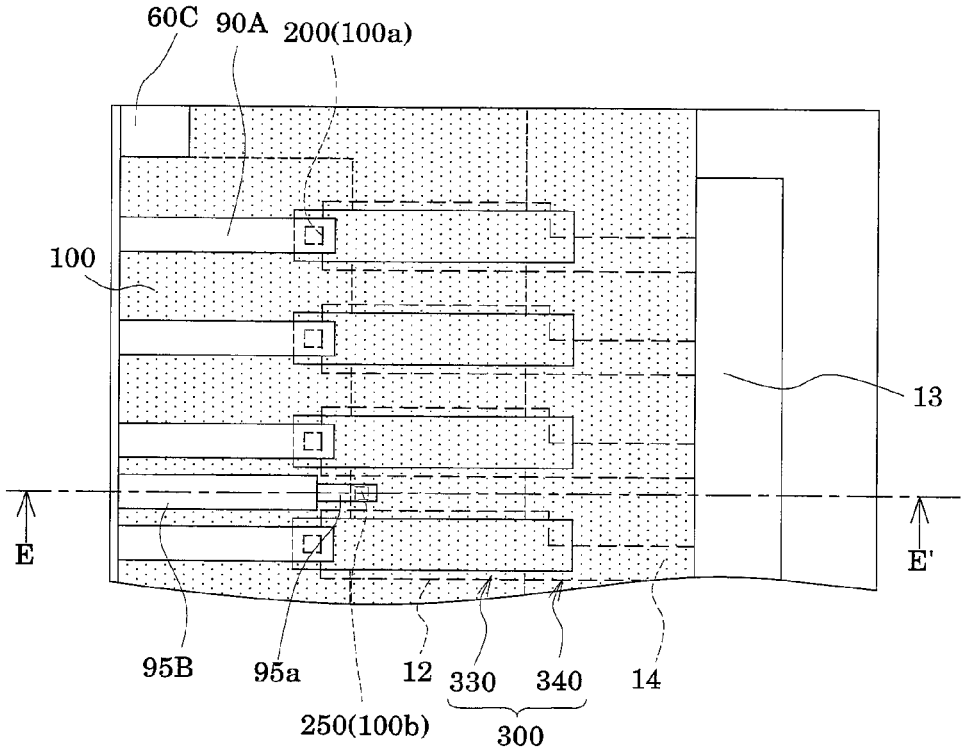
FIGS. 11(*a*) and 11(*b*) are enlarged plan and cross-sectional views of a main part of the recording head according to embodiment 6.
Figure 11B:
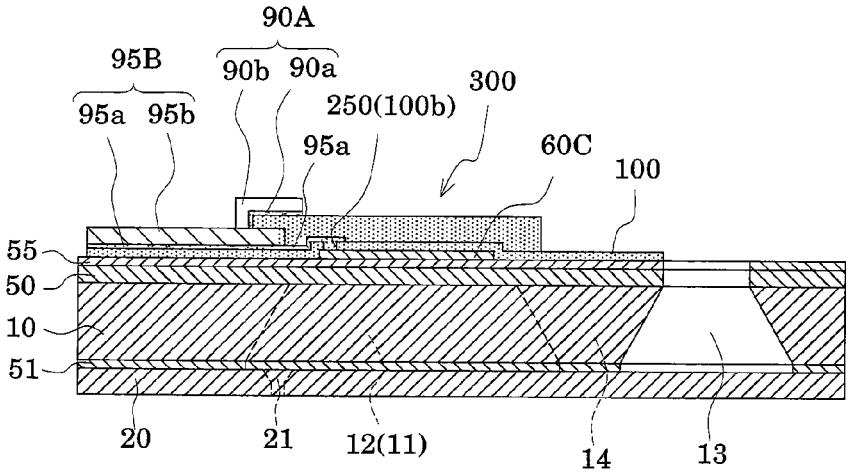

FIG. 9 is an exploded perspective view of an ink-jet recording head according to embodiment 6. FIG. 10(*a*) is a plan view of the ink-jet recording head according to embodiment 6, and FIG. 10(*b*) is a cross-sectional view along the line D-D' in FIG. 10(*a*). FIG. 11(*a*) is an enlarged plan view of a main part of the ink-jet recording head according to embodiment 6, and FIG. 11(*b*) is a cross-sectional view along the line E-E' in FIG. 11(*a*).

In this embodiment, as shown in FIGS. 9 to 11, a lower electrode film 60C is continuously provided over a region facing a plurality of arranged pressure generating chambers 12. To be more specific, the lower electrode film 60C is continuously provided across the region facing the pressure generating chambers 12 and regions facing compartment walls 11 on both sides in an arrangement direction of the pressure generating chambers 12 along the arrangement direction of the pressure generating chambers 12. Moreover, both ends of the lower electrode film 60C in a direction perpendicular to the arrangement direction of the pressure generating chambers 12 are positioned in the region facing the pressure generating chambers 12, respectively. Furthermore, a lead electrode 95B for a lower electrode is connected to the end of the lower electrode film 60C as described above. In this embodiment, the lead electrode 95B for the lower electrode has a two-layer structure, to be more specific, is formed of an adhesion layer 95*a* made of adhesive metal and a metal layer 95*b* which is made of a metal material and provided on the adhesion layer 95*a*.

Moreover, the lead electrode 95B for the lower electrode is provided in a region outside a region corresponding to a space between the pressure generating chambers 12. In addition, only the adhesion layer 95*a* which is included in the lead electrode 95B for the lower electrode is extended to reach the end of the lower electrode film 60C. Moreover, the lead electrode 95B for the lower electrode and the lower electrode film 60C are electrically connected to each other through the extended adhesion layer 95*a*. Embodiment 6 is the same as embodiment 1 described above except for those described above.

Furthermore, also in this embodiment, a pattern region that is a region where piezoelectric elements 300 are arranged is covered with an insulating film. On this insulating film 100, a lead electrode 90A for an upper electrode is drawn out, which is electrically connected to an upper electrode film 80 of the piezoelectric element 300 through a first contact hole 100*a*. Meanwhile, in the insulating film 100, a second contact hole 100*b* to be a connection portion 250, in which the lower electrode film 60C and the lead electrode 95B for the lower electrode are electrically connected to each other, is provided in the region corresponding to the space between the pressure generating chambers 12. For example, in this embodiment, the second contact hole 100*b* is provided in an end on one side of the insulating film 100 in the arrangement direction of the pressure generating chambers 12 in the region corresponding to the space between the pressure generating chambers 12, that is, the end on the side from which the lead electrode 90A for the upper electrode is drawn out.

As shown in FIGS. 10(*a*) and 10(*b*), the lead electrode 90A for the upper electrode as described above is formed of: an adhesion layer 90*a* which is made of adhesive metal such as a titanium-tungsten alloy and a nickel-chromium alloy, and is drawn out onto the insulating film 100 from the upper electrode film 80; and a metal layer 90*b* which is made of an aluminum alloy, gold or the like, and is provided on the adhesion layer 90*a*. Note that the adhesion layer 90*a* of the lead electrode 90A for the upper electrode is a relatively thin layer for attaching the metal layer 90*b* to the insulating film 100 and the like.

Meanwhile, in this embodiment, the lead electrode 95B for the lower electrode has the same structure as that of the lead electrode 90A for the upper electrode described above. To be more specific, as shown in FIGS. 11(*a*) and 11(*b*), the lead electrode 95B for the lower electrode is formed of: an adhesion layer 95*a* which is made of adhesive metal and electrically connected to the lower electrode film 60C; and a metal layer 95*b* which is provided on the adhesion layer 95*a*. Specifically, the adhesion layer 95*a* is formed of the same layer as the adhesion layer 90*a* of the lead electrode 90A for the upper electrode, and the metal layer 95*b* is formed of the same layer as the metal layer 90*b* of the lead electrode 90A for the upper electrode.

Moreover, the lead electrode 95B for the lower electrode, that is a portion where the adhesion layer 95*a* and the metal layer 95*b* as described above are laminated, is positioned in the region outside the region corresponding to the space between the pressure generating chambers 12. Moreover, in this embodiment, the lead electrode 95B for the lower electrode is extended to a region corresponding to a space between the lead electrodes 90A for the upper electrode on the insulating film 100 (the vicinity of the end of the passage-forming substrate 10). In this embodiment, the adhesion layer 95*a* included in the lead electrode 95B for the lower electrode as described above is extended to reach the end of the lower electrode film 60C. The extended adhesion layer (an extension portion) 95*a* is electrically connected to the lower electrode film 60C through the second contact hole 100*b* (the connection portion 250) in the insulating film 100. Thus, the lower electrode film 60C and the lead electrode 95B for the lower electrode are electrically connected to each other. Note that, in this embodiment, a width of the adhesion layer 95*a* extended from the lead electrode 95B for the lower electrode as described above is smaller than that of the lead electrode 95B for the lower electrode in the region corresponding to the space between the pressure generating chambers 12.

Here, a thickness of the adhesion layer 95*a* included in the lead electrode 95B for the lower electrode is, for example, about 0.1 to 0.3 μm, and is preferably equal to or smaller than that of the lower electrode film 60C, more preferably, smaller than that of the lower electrode film 60C. This is, although described in detail later, in order to effectively prevent rigidity of a vibration plate from being increased by formation of the adhesion layer 95*a* in the region facing the pressure generating chambers 12. For example, in this embodiment, the thickness of the lower electrode film 60C is set to about 0.2 μm, and the thickness of the adhesion layer 95*a* is set to about 0.1 μm. Meanwhile, a thickness of the metal layer 95*b* is, for example, about 1.0 to 3.0 μm, and is preferably larger than that of the lower electrode film 60C. This is in order to reduce a resistance value of the lower electrode film 60C. For example, in this embodiment, the thickness of the metal layer 95*b* is set to about 1.2 μm.

Note that, in this embodiment, the lead electrode 95B for the lower electrode described above, although not shown in the drawings, is patterned into a predetermined shape together with the lead electrode 90A for the upper electrode in the following manner. Specifically, the respective layers forming the piezoelectric element 300 are formed by use of deposition and a lithography method. Thereafter, a first layer and a second layer are laminated over the entire surface on one side of the passage-forming substrate 10. Subsequently, after the second layer is etched by use of a mask pattern made of resist and the like, the first layer is etched. Thus, the lead electrodes are patterned.

As described above, in the ink-jet recording head of this embodiment, the lead electrode 95B for the lower electrode is provided in the region outside the region corresponding to the space between the pressure generating chambers 12. In addition, the adhesion layer 95*a* included in the lead electrode 95B for the lower electrode is extended to reach the lower electrode film 60C. Moreover, the lead electrode 95B for the lower electrode and the lower electrode film 60C are electrically connected to each other through the extended adhesion layer 95*a*. Thus, a stable ink ejecting property can be obtained.

To be more specific, in this embodiment, the adhesion layer 95*a* included in the lead electrode 95B for the lower electrode is extended to reach the end of the lower electrode film 60C. Accordingly, the structure in which the lead electrode 95B for the lower electrode and the lower electrode film 60C are electrically connected to each other is obtained. Thus, even if the adhesion layer 95*a* is protruded into the region facing the pressure generating chambers 12 due to a manufacturing error, the rigidity of the vibration plate is hardly changed since the adhesion layer 95*a* is relatively thin. Moreover, the lead electrode 95B for the lower electrode is provided in the region outside the region corresponding to the space between the pressure generating chambers 12. Thus, the metal layer 95*b* is never formed in the region facing the pressure generating chambers 12 regardless of a manufacturing error of the metal layer 95*b*, for example, even if a slight variation occurs in dimensions of the metal layer 95*b* or even if a formation position of the metal layer 95*b* is slightly shifted. Therefore, even if a manufacturing error of the lead electrode 95B for the lower electrode occurs, a variation in the ink ejecting property can be reliably prevented.

Moreover, in this embodiment, by connecting the lead electrode 95B for the lower electrode to the lower electrode film 60C, a voltage drop in simultaneously driving a plurality of the piezoelectric elements 300 can be reliably prevented. To be more specific, as in the case of this embodiment, since the lower electrode film 60C included in the piezoelectric element 300 formed of thin films is thin, the resistance value thereof is likely to become relatively high. However, the resistance value of the lower electrode film 60C is reduced by connecting the lead electrode 95B for the lower electrode to the lower electrode film 60C as described above. Thus, the voltage drop in simultaneously driving the plurality of piezoelectric elements 300 can be reliably prevented. Therefore, it is also possible to reliably prevent the variation in the ink ejecting property due to the voltage drop.

Embodiment 7

Figure 12A:
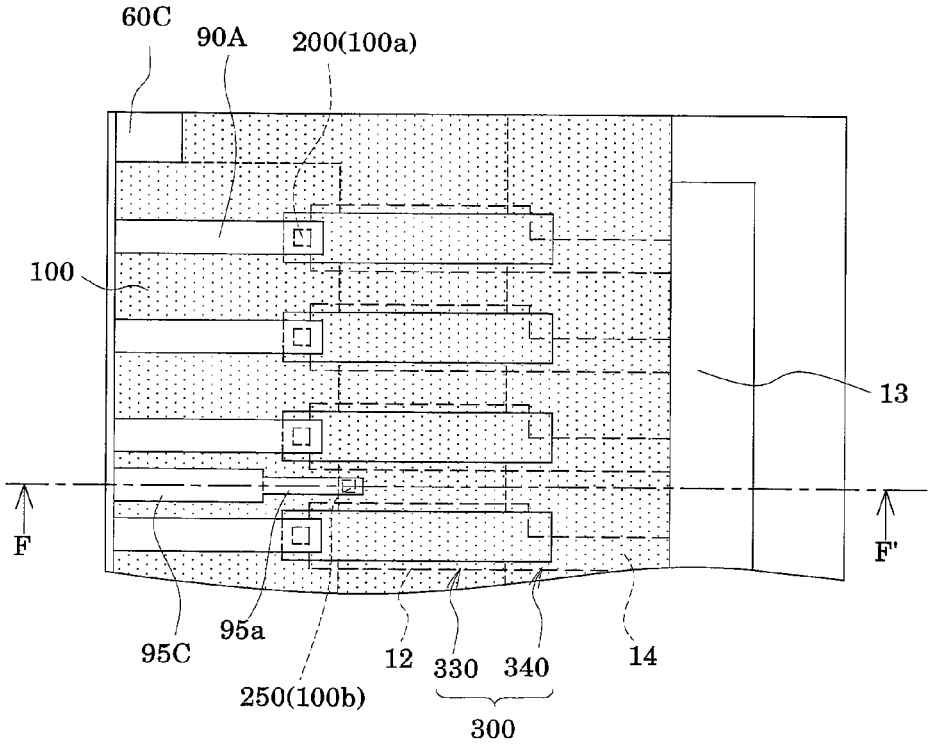
FIGS. 12(*a*) and 12(*b*) are enlarged plan and cross-sectional views of a main part of a recording head according to embodiment 7.
Figure 12B:
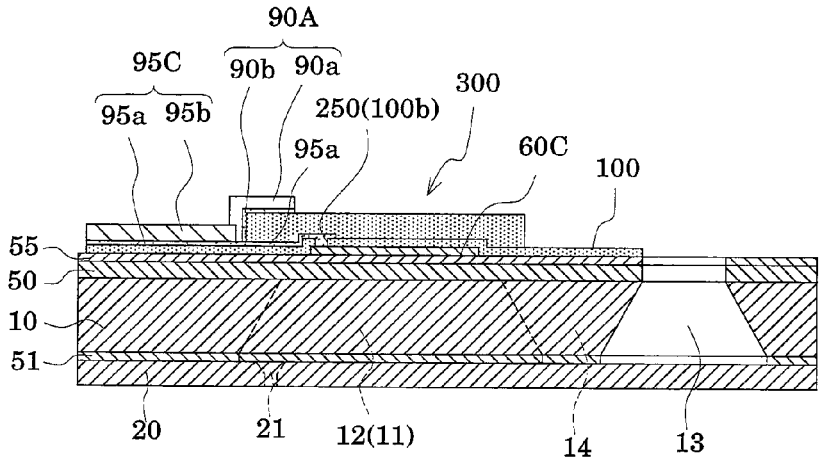

FIG. 12(*a*) is an enlarged plan view of a main part of an ink-jet recording head according to embodiment 7 of the present invention, and FIG. 12(*b*) is a cross-sectional view along the line F-F' in FIG. 12(*a*). In embodiment 6 described above, the description was given by exemplifying the structure in which the lead electrode 95B for the lower electrode is provided outside the region corresponding to the space between the pressure generating chambers 12. Meanwhile, in this embodiment, as shown in FIGS. 12(*a*) and 12(*b*), a lead electrode 95C for a lower electrode is provided in a region outside a region corresponding to a space between piezoelectric elements 300. With the structure as described above, the same effects as those of embodiment 1 described above can be obtained.

Moreover, as in the case of this embodiment, by providing the lead electrode 95C for the lower electrode in the region outside the region corresponding to the space between the piezoelectric elements 300, there will be no restrictions on an interval between the piezoelectric element 300 and the lead electrode 95C for the lower electrode, and the like at the time of manufacturing. Thus, the piezoelectric elements 300 can be densely arranged by narrowing a distance between the piezoelectric elements 300 while maintaining a stable ink ejecting property.

Embodiment 8

Figure 13A:
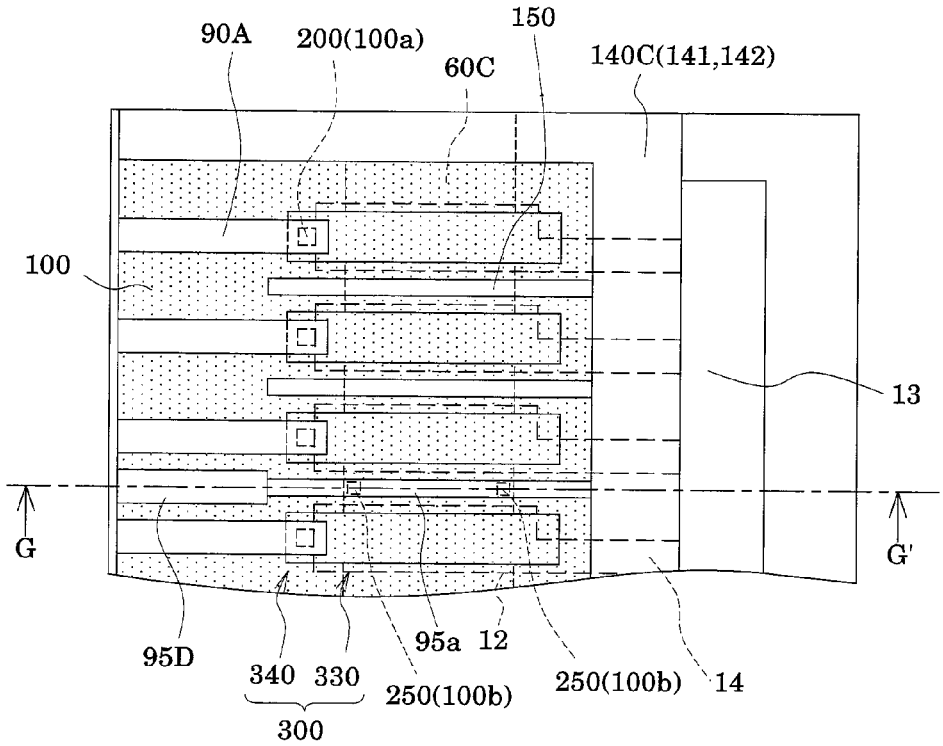
FIGS. 13(*a*) and 13(*b*) are enlarged plan and cross-sectional views of a main part of a recording head according to embodiment 8.
Figure 13B:
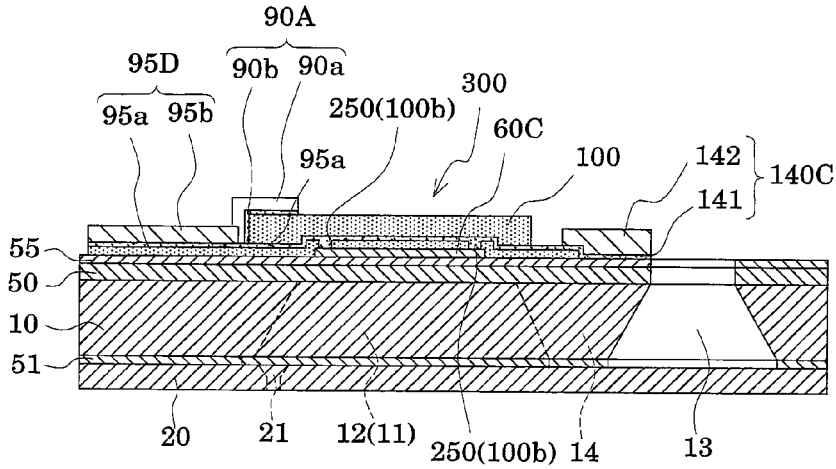

FIG. 13(*a*) is an enlarged plan view of a main part of an ink-jet recording head according to embodiment 8 of the present invention, and FIG. 13(*b*) is a cross-sectional view along the line G-G' in FIG. 13(*a*). In embodiment 6 described above, the description was given by exemplifying the structure in which the adhesion layer 95*a* included in the lead electrode 95B for the lower electrode is extended to reach the end of the lower electrode film 60C. Meanwhile, in this embodiment, as shown in FIGS. 13(*a*) and 13(*b*), a common electrode pattern 140C is provided along an arrangement direction of pressure generating chambers 12 in a region outside an end of the pressure generating chamber 12 on a side opposite to a lead electrode 95D for a lower electrode. Accordingly, an adhesion layer 95*a* included in the lead electrode 95D for the lower electrode is extended to reach the common electrode pattern 140C.

Here, in this embodiment, the common electrode pattern 140C is formed of: a first common electrode pattern 141 which has the same structure as that of the lead electrode 95D for the lower electrode, to be more specific, which is made of the same layer as that forming the adhesion layer 95*a*; and a second common electrode pattern 142 which is made of the same layer as that forming a metal layer 95*b*. Note that, in this embodiment, respective layers forming a piezoelectric element 300 are covered with an insulating film 100 except for a portion where the first and second common electrode patterns 141 and 142 are laminated.

The adhesion layer 95*a* extended from the lead electrode 95D for the lower electrode is extended to reach the common electrode pattern 140C described above. Specifically, the lead electrode 95D for the lower electrode and the common electrode pattern 140C are electrically connected to each other through the adhesion layer 95*a* extended from the lead electrode 95D for the lower electrode. Moreover, the adhesion layer 95*a* extended from the lead electrode 95D for the lower electrode is connected to the lower electrode film 60C through a second contact hole 100*b* in the insulating film 100 at both ends of a region corresponding to a space between the piezoelectric elements 300 in the arrangement direction of the pressure generating chambers 12. With the structure as described above, a resistance value of the lower electrode can be further reduced, and a voltage drop can be more reliably prevented.

Furthermore, in this embodiment, the adhesion layers 95*a* are provided in respective regions facing compartment walls 11 of the plurality of arranged pressure generating chambers 12. The respective adhesion layers 95*a* are provided to have the same pattern shape in the regions facing the compartment walls of the pressure generating chambers 12. Moreover, one of the plurality of adhesion layers 95*a* is the adhesion layer 95*a* extended from the lead electrode 95B for the lower electrode, and the rest are dummy electrodes 150 formed of only the adhesion layers 95*a*. With the structure as described above, vibration characteristics of a vibration plate in each of the piezoelectric elements 300 are uniformized. Thus, a variation in an ink ejecting property can be reliably prevented.

Other Embodiment

Although embodiments 1 to 8 of the present invention have been described above, needless to say, the present invention is not limited to embodiments 1 to 8 described above. For example, in embodiments 1 to 8 described above, the description was given by exemplifying the structure in which the respective layers forming the piezoelectric element are covered with the insulating film, and the lead electrode for the upper electrode and the lead electrode for the lower electrode are drawn out onto the surface of the insulating film. However, needless to say, the present invention is not limited to the structure described above but may have a structure in which the lead electrode for the upper electrode connected to each of the piezoelectric elements and the lead electrode for the lower electrode connected to the lower electrode film are covered with the insulating film except for a connection portion between the lead electrodes for the upper and lower electrodes and an external wiring.

Note that, in the structure as described above, it is preferable to use an aluminum alloy for a material to form metal layers of the lead electrodes for the upper and lower electrodes. The metal layer made of the aluminum alloy has a relatively flat surface. Thus, adhesion between the insulating film and the lead electrodes can be improved. Moreover, if the same kind of material, for example, aluminum oxide is used for a material of the insulating film, the adhesion between the insulating film and the lead electrodes can be further improved.

Particularly, in the case where the structure of each of embodiments 5 to 7 described above is set to be the structure in which the lead electrodes for the upper and lower electrodes are covered with the insulating film as described above, for example, the following structure may be adopted. Specifically, in the structure, a common lead portion is provided by drawing out, to the lead electrode for the lower electrode, the end of the lower electrode film on the side of the lead electrode for the upper electrode in the region corresponding to the space between the pressure generating chambers. In addition, an adhesion layer is extended from the lead electrode for the lower electrode on the common lead portion. Moreover, the lead electrode for the lower electrode and the lower electrode film are electrically connected to each other through the adhesion layer on the common lead portion. With the structure as described above, a thickness of a portion where the lower electrode and the lead electrode for the lower electrode are connected to each other can be sufficiently secured. Moreover, a voltage drop can be more reliably prevented.

Moreover, in embodiments 1 to 8 described above, the description was given by exemplifying the structure in which the both ends of the lower electrode film in the arrangement direction of the pressure generating chambers are provided in the region facing the pressure generating chambers. However, needless to say, the present invention is not limited to the structure described above but may have a structure in which the lower electrode film is extended to a region facing arranged ink supply paths on one surface of the passage-forming substrate from the region facing the plurality of arranged pressure generating chambers. With the structure as described above, it is possible to sufficiently secure rigidity of a vibration plate in the region facing the ends of the pressure generating chambers on the side of the ink supply paths.

Furthermore, in embodiments 1 to 8 described above, the description was given by exemplifying the structure in which the both ends of the piezoelectric element are extended to the region facing the peripheral wall of the pressure generating chamber. However, needless to say, the present invention is not limited to the structure described above but may have, for example, a structure in which ends of each piezoelectric element on the communicating portion side are provided in the region facing the pressure generating chambers. With the structure as described above, a proportion of an area occupied by the common electrode pattern with respect to the entire surface of the one side of the passage-forming substrate can be increased. Thus, the voltage drop can be more reliably prevented.

Figure 14:
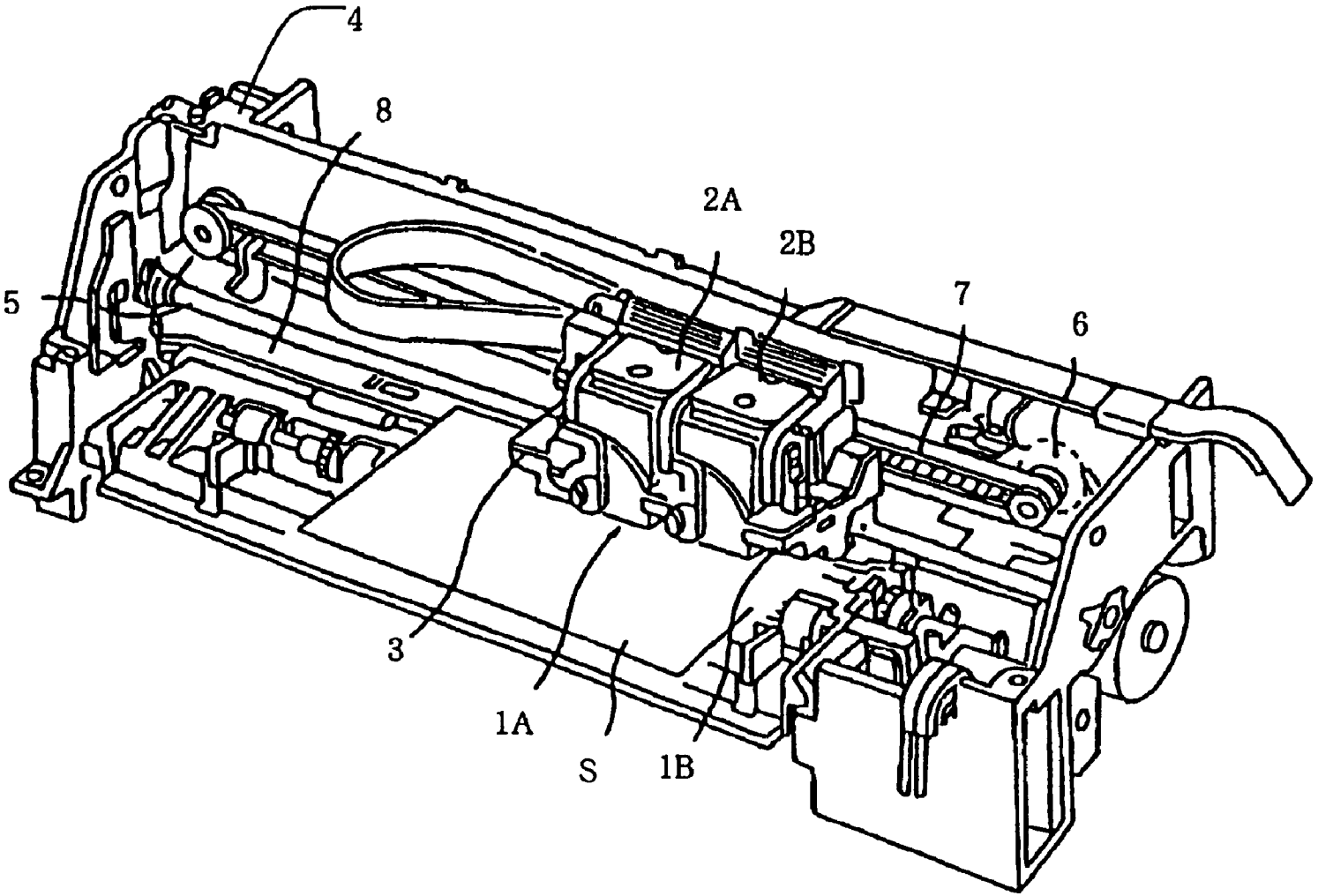
FIG. 14 is a schematic view of a recording apparatus according to an embodiment.

The ink-jet recording head of each of the embodiments as described above forms a part of a recording head unit including an ink passage communicating with an ink cartridge and the like, and is mounted on an ink-jet recording apparatus. FIG. 14 is a schematic view showing one example of the ink-jet recording apparatus. As shown in FIG. 14, in recording head units 1A and 1B having the ink-jet recording heads, cartridges 2A and 2B included in ink supply means are detachably provided. A carriage 3 having these recording head units 1A and 1B mounted thereon is provided as movable in an axial direction on a carriage shaft 5 attached to an apparatus main body 4. These recording head units 1A and 1B are, for example, ones which eject a black ink composition and a color ink composition, respectively. A drive force of a drive motor 6 is transmitted to the carriage 3 via a plurality of unillustrated gears and a timing belt 7. Thus, the carriage 3 having the recording head units 1A and 1B mounted thereon is moved along the carriage shaft 5. Meanwhile, a platen 8 is provided along the carriage shaft 5 in the apparatus main body 4, and a recording sheet S that is a recording medium such as paper fed by an unillustrated feed roller or the like is carried on the platen 8.

Moreover, the ink-jet recording head was described as an example of the liquid-jet head of the present invention. However, the basic configuration of the liquid-jet head is not limited to the one described above. The present invention is aimed widely at general liquid-jet heads and, needless to say, can also be applied to ones ejecting liquids other than ink. As the other liquid-jet heads, cited are, for example: various kinds of recording heads used in an image recording apparatus such as a printer; a color material jet head used for manufacturing color filters of a liquid crystal display and the like; an electrode material jet head used for forming electrodes of an organic EL display, a field emission display (FED) and the like; a bio-organic matter jet head used for manufacturing biochips; and the like.

What is claimed is:

1. A liquid-jet head comprising:

pressure generating chambers communicating with nozzle orifices ejecting a liquid;

piezoelectric elements which are provided in a region facing the pressure generating chambers and each of which includes a lower electrode, a piezoelectric layer and an upper electrode; and a lead electrode for the lower electrode, which is drawn out from the lower electrode;

wherein:

when the region facing a plurality of arranged pressure generating chambers and a region facing the compartment walls of the plurality of arranged pressure generating chambers are called a first region and a direction perpendicular to an arrangement direction of the plurality of pressure generating chambers is called a first direction;

the lower electrode is a common electrode provided at least in the first region and has a common lead portion which is drawn out to outside of the first region from at least one side, in the first direction of the lower electrode;

the lead electrode for the lower electrode is electrically connected to the common lead portion of the lower electrode; and a connection portion of the lead electrode for the lower electrode and the common lead portion is positioned in a region outside of the region, wherein a common electrode pattern connected to the lower electrode is provided along the arrangement direction of the pressure generating chambers in a region outside an end opposite to the lead electrode for the lower electrode in the region facing the plurality of arranged pressure generating chambers.

2. The liquid-jet head according to claim 1, wherein the common lead portion at least part is provided in a region corresponding to the compartment wall of the pressure generating chamber.

3. A liquid-jet apparatus comprising the liquid-jet head according to claim 2.

4. The liquid-jet head according to claim 1, wherein the common lead portion is further drawn out to reach the common electrode pattern from an end on the other side of the lower electrode.

5. A liquid-jet apparatus comprising the liquid-jet head according to claim 4.

6. The liquid-jet head according to claim 1, wherein the lower electrode is continuously provided to reach the common electrode pattern from the region facing the plurality of arranged pressure generating chambers.

7. A liquid-jet apparatus comprising the liquid-jet head according to claim 6.

8. The liquid-jet head according to claim 1, wherein the other end of the piezoelectric element on the side corresponding to the common electrode pattern is positioned in the region facing the pressure generating chambers.

9. A liquid-jet apparatus comprising the liquid-jet head according to claim 8.

10. A liquid-jet apparatus comprising the liquid-jet head according to claim 1.

* * * * *